US007024913B2

(12) United States Patent
Tang et al.

(10) Patent No.: US 7,024,913 B2
(45) Date of Patent: Apr. 11, 2006

(54) ADJUSTABLE STROKE MECHANISM

(75) Inventors: Wenliang Tang, Sidney, OH (US); John B. Bornhorst, New Bremen, OH (US); Richard J. Oen, Wapakoneta, OH (US); Charles H. Dickman, Minster, OH (US); Kevin J. Evers, Fort Recovery, OH (US); Ryan M. Stoltz, St. Henry, OH (US); Joseph H. Hamberg, New Bremen, OH (US)

(73) Assignee: The Minster Machine Company, Minster, OH (US)

( * ) Notice: Subject to any disclaimer, the term of this patent is extended or adjusted under 35 U.S.C. 154(b) by 354 days.

(21) Appl. No.: 10/219,591

(22) Filed: Aug. 15, 2002

(65) Prior Publication Data

US 2003/0041643 A1 Mar. 6, 2003

Related U.S. Application Data

(60) Provisional application No. 60/312,840, filed on Aug. 16, 2001.

(51) Int. Cl.
*B30B 1/26* (2006.01)

(52) U.S. Cl. ..... 72/446; 100/257

(58) Field of Classification Search ..... 72/446, 72/450; 100/257

See application file for complete search history.

(56) References Cited

U.S. PATENT DOCUMENTS 3,180,178 A * 4/1965 Brown
5,189,928 A * 3/1993 Ontrop et al.
5,307,709 A * 5/1994 Bareis
5,865,070 A * 2/1999 Bornhorst
6,032,360 A * 3/2000 Bornhorst et al. ..... 29/888.01
6,647,869 B1 * 11/2003 Bornhorst et al. ..... 100/257

* cited by examiner

*Primary Examiner*—Daniel C. Crane
(74) *Attorney, Agent, or Firm*—Randall J Knuth

(57) ABSTRACT

An adjustment stroke connection for a mechanical press includes an eccentric bushing disposed within a press connection member and an eccentric crankshaft member disposed within the eccentric bushing. A rotatable crankshaft is connected to the eccentric member. A mechanism is provided for connecting the eccentric bushing with the press connection member in a manner that prevents rotation therebetween and concurrently permits rotation of the eccentric member relative to the eccentric bushing. When the mechanism is activated, driving rotation of the crankshaft produces a press stroke adjustment. A torque actuator delivers equal driving torque to plural eccentric crankshaft members to enable minimization of relative bushing angle slip. Suitable control of the bushing angle and slide position crank angle during bushing expansion and contraction also minimizes relative bushing angle slip.

20 Claims, 17 Drawing Sheets

Definitions: $r_c$ - crank throw
$r_b$ - bushing eccentricity
$r_e$ - effective crank throw

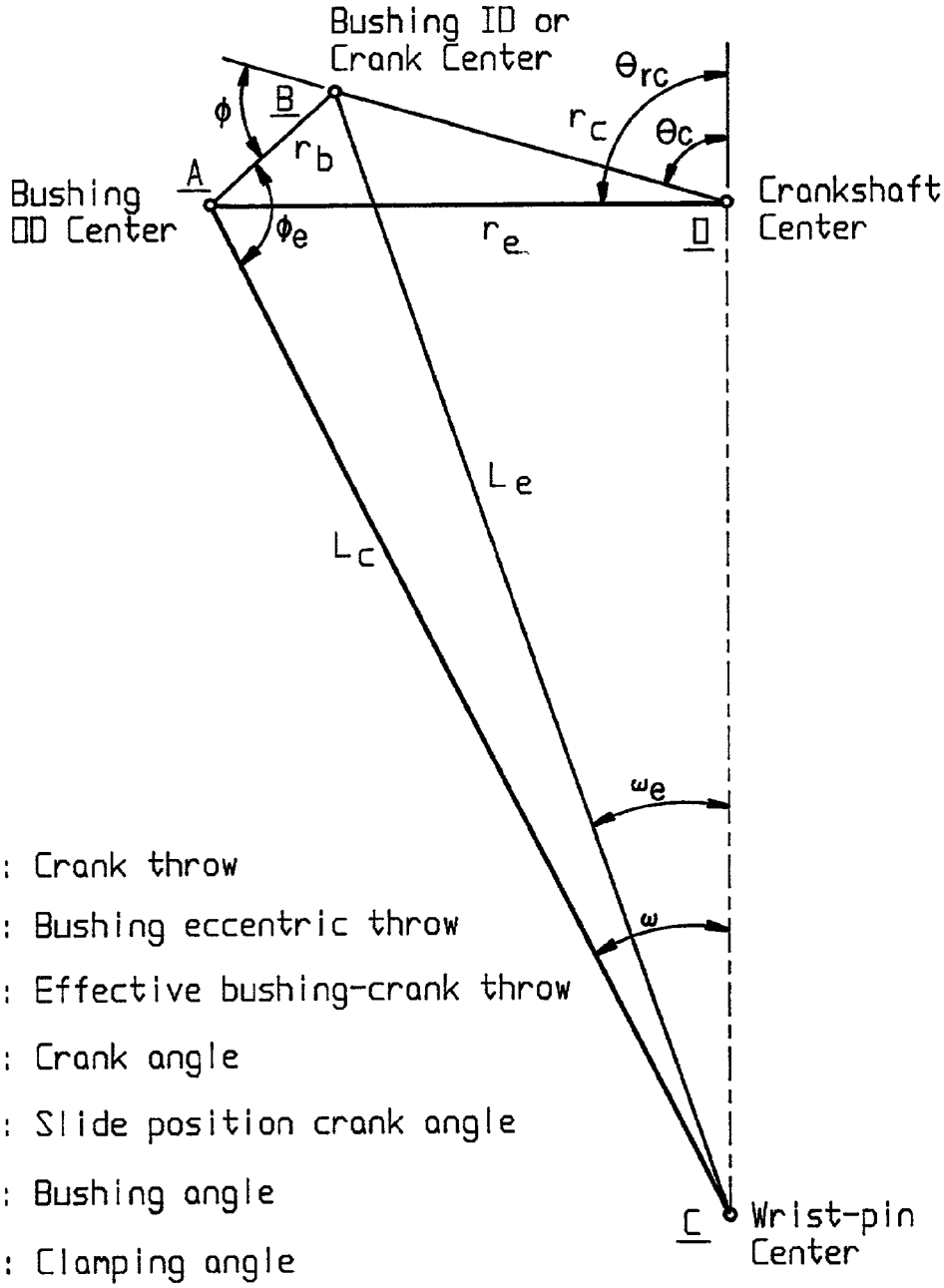

$r_c$ : Crank throw $r_b$ : Bushing eccentric throw $r_e$ : Effective bushing-crank throw $\theta_c$ : Crank angle $\theta_{rc}$ : Slide position crank angle $\phi$ : Bushing angle $\phi_e$ : Clamping angle $L_c$ : Connection length $L_e$ : Effective connection length for bushing adjusting $\omega$: Connection tilt angle $\omega_e$: Connection tilt angle for bushing adjusting

Fig. 5

(a) Static torque distribution during bushing expansion.

(b) Applied torque distribution during bushing expansion.

(c) Static and applied torque distribution during bushing contraction.

(d) Bushing angle slip due to seal elastic twisting during expansion and contraction.

(b) Slide position crank angle with maximum torque on bushing seal.

(a) Slide position crank angle with minimum torque on bushing seal.

ADJUSTABLE STROKE MECHANISM

CONTINUATION DATA

The present application hereby claims the benefit under Title 35, United States Code §119(e) of United States provisional application No. 60/312,840 filed Aug. 16, 2001.

BACKGROUND OF THE INVENTION

1. Field of the Invention

The present invention relates to mechanical stamping and drawing presses, and, more particularly, to an apparatus for an adjustable stroke connection for adjusting the stroke length of the press slide.

2. Description of the Related Art

In mechanical presses, it is often desirable to adjust or change the stroke length of a reciprocating member, for example, the slide, to which stamping tooling is installed. In some conventional toothed adjustment systems, there is a tendency for the system parts to wear after a certain period of operation time. It would be desirable to provide an apparatus or system which may be utilized to quickly, easily, and accurately adjust the stroke length of the slide or other press parts.

SUMMARY OF THE INVENTION

According to the present invention there is provided an adjustable stroke connection system employing eccentric crankshaft members for use in changing the stroke length of the slide or other member of a mechanical press. More particularly, the present invention provides an apparatus to compensate for slip activity in the eccentric bushing during stroke adjustment operations, which produce unwanted variations in the stroke length.

According to the connection system of the present invention, an eccentric member fixedly mounted on a rotatable crankshaft is provided with an eccentric bushing disposed thereon. A press connection member, such as a connecting rod or link, is attached at one end about the eccentric bushing and secured at another end to the press slide. During normal operation, rotation of the crankshaft is transmitted as an applied torque to the eccentric bushing via the eccentric crank member, producing relative movement between the eccentric bushing and connecting member or arm to thereby cause reciprocation of the press slide.

During stroke adjustment, pressurized oil is communicated between the eccentric bushing and eccentric crank member, thereby relieving the press fit or interference-type fit therebetween and causing the eccentric bushing to expand and form a temporary press fit connection with the connecting arm. At this time, the crankshaft may be rotated, along with its co-rotating eccentric member, to thereby change the position of the crankshaft eccentric relative to the eccentric bushing. This results in a change in stroke length. The oil pressure is then relieved, thereby causing the eccentric bushing to contract and again form a press fit or interference fit with the crankshaft eccentric; concurrently, the temporary press fit connection between the outside of the eccentric bushing and the connection member or arm is released. After such high oil pressure has been reduced, normal press operations may proceed at the new stroke length.

The invention, in one form thereof, is directed to a mechanical press. The press includes a rotatable crankshaft and at least one eccentric crankshaft member rotatably driven by the crankshaft. A respective eccentric bushing is disposed about each eccentric member to define a respective interface therebetween. Each eccentric bushing and its associated eccentric member are releasably connectable with one another. Each eccentric bushing is normally operatively arranged in a press-fit connection with its associated eccentric member. A respective press connection member is disposed in operative driving connection with each eccentric bushing. A means is provided for reversibly removing each eccentric bushing from the press-fit connection with its associated eccentric member. A torque actuator, which is operative during the reversible removal of each eccentric bushing from the press-fit connection with its associated eccentric member, is provided for applying substantially the same torquing drive action to each eccentric crankshaft member to effect rotation of the crankshaft and cause a press stroke adjustment.

The invention, in another form thereof, is directed to a mechanical press. The press includes a rotatable crankshaft and at least one eccentric crankshaft member rotatably driven by the rotatable crankshaft. A respective eccentric bushing is disposed about each eccentric member to define a respective interface therebetween. Each eccentric bushing and its associated eccentric member are releasably connectable with one another. Each eccentric bushing is normally operatively arranged in a press-fit connection with its associated eccentric member. A respective press connection member is disposed in operative driving connection with each eccentric bushing.

There is provided a means which is operative in a bushing expansion mode to reversibly remove each eccentric bushing from the normal press-fit connection with its associated eccentric member by expanding the eccentric bushing towards its associated press connection member. The means is further operative in a bushing contraction mode to restore each eccentric bushing subjected to expansion to the normal press-fit connection with its associated eccentric member. A control means is operative during at least one of the respective bushing expansion mode and the respective bushing contraction mode associated with at least one of the eccentric bushings. The control means, in particular, controls at least one of the slide position crank angle of the crankshaft and the respective bushing angle for at least one of the eccentric bushings. The control function performed by the control means is preferably directed towards the minimization of relative bushing angle slip between respective ones of the eccentric bushings.

The invention, in yet another form thereof, is directed to a mechanical press using a slide parallelism monitoring device. The press includes a rotatable crankshaft and at least one eccentric crankshaft member rotatably driven by the rotatable crankshaft. A respective eccentric bushing is disposed about each eccentric member to define a respective interface therebetween. Each eccentric bushing and its associated eccentric member are releasably connectable with one another. Each eccentric bushing is normally operatively arranged in a press-fit connection with its associated eccentric member. A respective press connection member is disposed in operative driving connection with each eccentric bushing.

A means is provided for reversibly removing each eccentric bushing from the press-fit connection with its associated eccentric member. A torque actuator, which is operative during the reversible removal of each eccentric busing from the press-fit connection with its associated eccentric member is provided for applying substantially the same torquing drive action to each eccentric crankshaft member to effect rotation of the crankshaft and cause a press stroke adjustment. A controller is used to activate the torque actuator which rotates the crankshaft to a desired position based on data received from the slide parallelism measuring device.

The invention, in another form thereof, is directed to an apparatus for correcting slide parallelism. The apparatus includes at least one eccentric crankshaft member. A device for measuring slide parallelism passes data to an eccentric controller. The eccentric controller is used to change the position of the eccentric crankshaft member based on the data frm the controller.

One advantage of the present invention is that a mechanical press may now include a simple and compact stroke adjustment connection operated by fluid pressure. Prior stroke adjustment connections utilized keys and/or gearing between the crankshaft and various eccentrics. The present invention utilizes a connection that is simple in design and vastly reduces the number of parts necessary for a stroke adjustment mechanism.

Another advantage of the present invention is that a significant reduction in costs is obtained along with increasing the functionality of the press with a simple stroke adjustment connection. Additionally, maintenance costs for adjustment and replacement parts, as compared to prior adjustable stroke connections, are reduced.

A further advantage of the invention is that a compensation mechanism is provided to reduce and/or eliminate the relative bushing angle slip between the individual crankshaft eccentric members.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 5 is a diagrammatic representation of the geometric relationships among the components depicted in FIG. 3;

FIG. 9 is a graph plotting measured stroke length versus the number of pressurization cycles of bushing expansion/contraction;

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
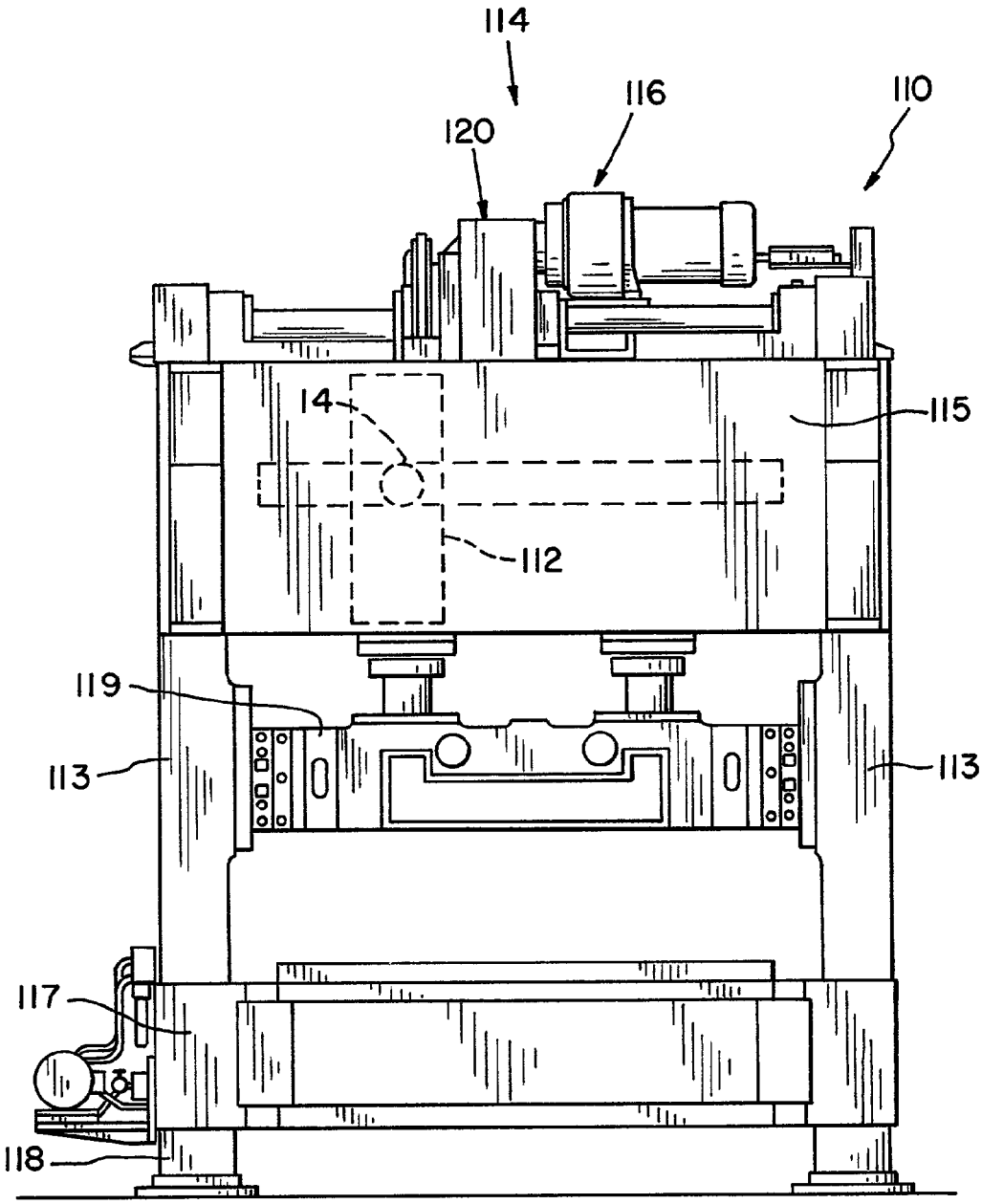
FIG. 1 is an elevational view of a typical mechanical press utilizing the present invention.

The adjustable stroke connection of the present invention is ideally suited for a wide assortment of configurations of mechanical, stamping presses. Referring to FIG. 1, a conventional mechanical press 110 typically includes a crown portion 115, a bed portion 117 having a bolster assembly connected thereto, and uprights 113 connecting crown portion 115 with the bed portion 117. Uprights 113 are connected to or integral with the underside of the crown and the upper side of the bed. A slide 119 is positioned between uprights 113 for guided, reciprocating movement relative to the bed. Tie rods (not shown), which extend through the crown, uprights and bed portion, are attached at each end with tie rod nuts. Leg members 118 are formed as an extension of the bed and are generally mounted on the shop floor by means of shock absorbing pads.

In order to power the reciprocating motion of slide 119, a drive mechanism 114 for the press is provided. A suitable mechanism includes a drive motor 116 attached by means of a belt to an auxiliary flywheel 120 attached to crown 115. The auxiliary flywheel 120 is connected to a main flywheel 112, which in turn is selectively engaged by the clutch of the combination clutch/brake to power the rotation of the press crankshaft 14, which in turn effects slide motion via connections extending between the slide and crankshaft.

This description of press 110 and its drive mechanism is merely illustrative as it should be apparent that the present invention may be utilized with a wide variety of mechanical presses employing a crankshaft-type device to achieve reciprocating motion of a press component. An example of a mechanical press is disclosed in U.S. Pat. No. 5,189,928 entitled "ADJUSTABLE STROKE PUNCH PRESS", which patent is incorporated herein by reference thereto.

Figure 2:
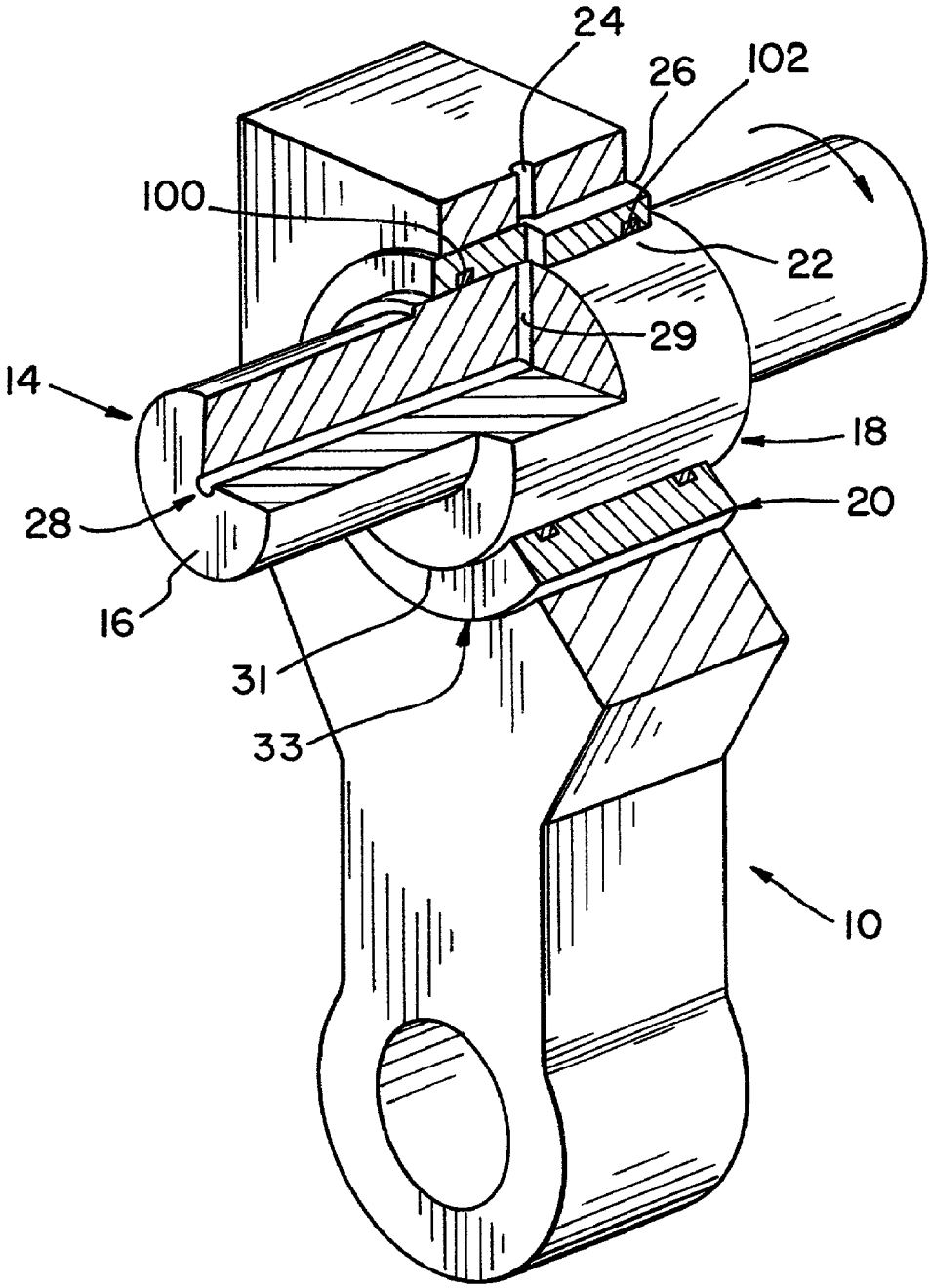
FIG. 2 is a schematic, perspective view in partial cutaway of a portion of the crankshaft and slide connection.

Referring now to FIG. 2, there is schematically shown in perspective view a portion of the crankshaft, its associated eccentric bushing, and the connection that is powered by crankshaft rotation. The connection may be formed of a bottom portion and a cap, wherein the bottom portion of connection member 10 would typically be attached in a suitable manner to the press slide. The crankshaft 14 includes a cylindrical main portion 16 axially centered on the crankshaft axis of rotation and further includes an eccentric member such as a cylindrical eccentric 18 rotatably fixed to crankshaft main portion 16 or integrally formed therewith.

Although only one crankshaft eccentric is shown, multiple eccentrics would be provided along the axial length of crankshaft 14 to cooperate with additional connections (not shown) for purposes of reciprocatingly driving the slide. In particular, crankshaft 14 may be provided with a plurality of discrete slide connection assemblies axially disposed in spaced-apart relationship along the longitudinal dimension of crankshaft 14. Accordingly, the discussion herein pertaining to the configuration shown in FIG. 2 applies equally to any other such slide connection assembly coupled to crankshaft 14.

Disposed about crankshaft eccentric 18 in a ring-like manner is a bronze eccentric bushing 20. During normal press operation, as crankshaft 14 rotates, the eccentric bushing 20 is held in place on crankshaft eccentric 18 (i.e., rotates in unison therewith) by a press fit or interference fit around the crankshaft eccentric circumference at 22 that is sufficient to transmit the torque required to accomplish the stamping or forming operation.

Oil is supplied to lubricate the rotation of eccentric bushing relative to connection 10. For example, oil passes through the top of the connection cap at conduit 24 into a radial clearance 26 defined between connection 10 and bushing 20 to create an oil film therebetween that facilitates free rotation of the crankshaft 14 and its eccentric bushing relative to connection 10. As crankshaft 14 and its co-rotating eccentric bushing 20 rotate relative to connection 10, the connection 10 moves up and down to effect a reciprocating motion of slide 119.

When a change or adjustment in the stroke of slide 119 is desired, rotation of crankshaft 14 (and therefore reciprocating motion of the slide) is stopped, and the oil supply through conduit 24 at the top of connection 10 is suspended. Next, high pressure oil is supplied through crankshaft 14 to the inside diameter of eccentric bushing 20, such as through axial bore 28 and one or more cross bores 29. The high pressure oil is distributed circumferentially around crankshaft eccentric 18 and exerts a radially outward pressure upon the inner diameter surface of eccentric bushing 20. Seals 100, 102 may be provided, such as along the axial edges at the inside diameter of bushing 20 to prevent escape of the high pressure oil.

The high pressure oil tends to circularly expand bushing 20, thereby relieving the press fit connection between crankshaft eccentric 18 and eccentric bushing 20. The high pressure oil in effect creates a small radial clearance between bushing 20 and crankshaft eccentric 18 indicated generally at 31. If the pressurization is sufficiently high, the process of expanding bushing 20 to relieve the normal-use press fit connection between crankshaft eccentric 18 and bushing 20 will lead to the simultaneous formation of a temporary press fit or interference fit connection developed circumferentially between bushing 20 and connection 10, indicated generally at 33.

In this temporary condition, the lubricated radial clearance 31 allows crankshaft 14 to rotate relative to bushing 20, which does not rotate due to its temporary press fit engagement with connection member 10. As crankshaft 14 is made to rotate as part of the adjustment procedure, this rotary motion causes the crankshaft main portion 16 (and crankshaft eccentric member 18 secured thereto) to shift into a different position relative to eccentric bushing 20, thereby effectively changing the stroke length of connection 10 to a desired length.

When the adjustment is completed, the high pressure oil present at area 31 that is being supplied through crankshaft 14 is removed, allowing the eccentric bushing 20 to return to its normal press fit with crankshaft eccentric 18. The resiliency of the metal construction of bushing 20 allows it to return to its original press fit configuration with crankshaft eccentric 18. At this point, rotation of crankshaft 14 may be resumed at the new stroke length to effectuate reciprocation of the slide connection and thereby continue with the stamping operations.

A more detailed disclosure of the apparatus shown in FIG. 2 and its functionality may be found in U.S. Pat. No. 5,865,070 entitled "ADJUSTABLE STROKE CONNECTION", which patent is incorporated herein by reference thereto.

Figure 3:
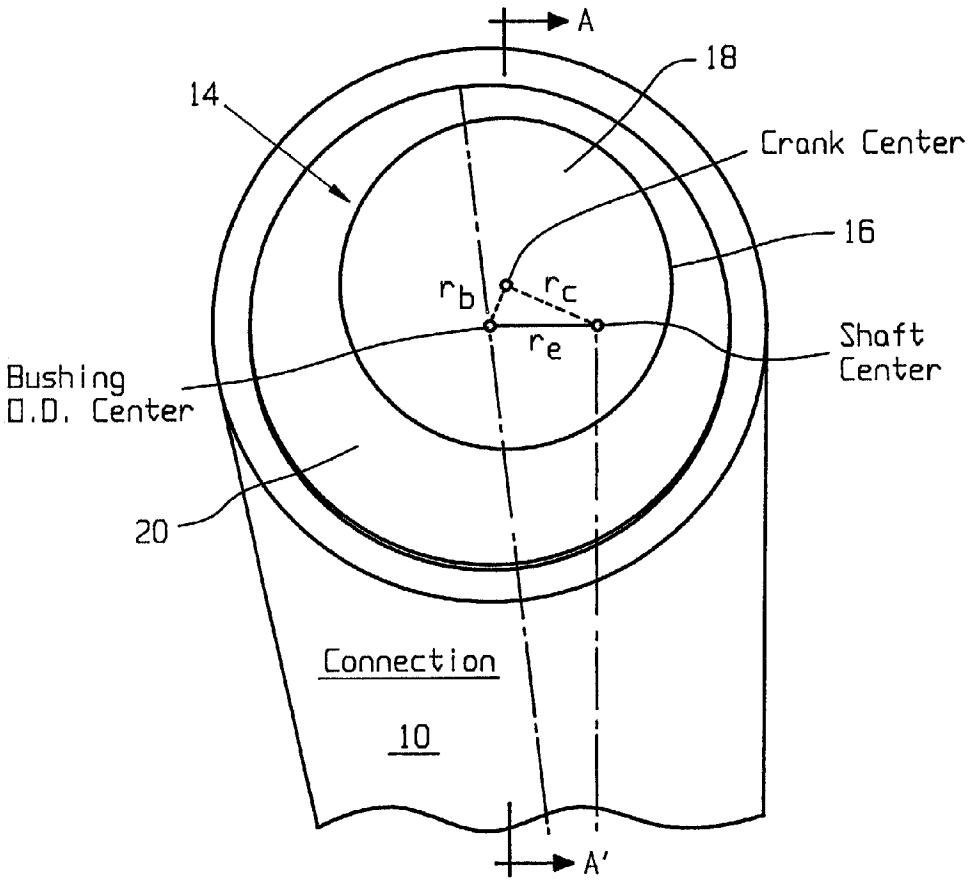
FIG. 3 is an axial cross-sectional view of a slide adjustment apparatus.
Figure 4:
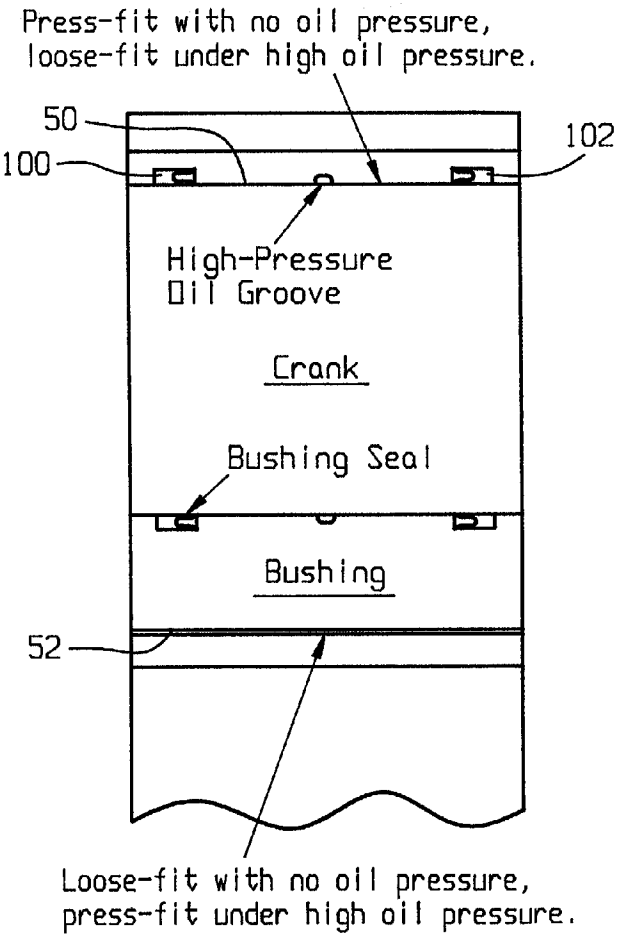
FIG. 4 is a lateral cross-sectional view taken along lines A–A' of FIG. 3.

Referring now to FIG. 3, there is shown in axial cross-sectional view one illustrative arrangement for the adjustable stroke connection apparatus shown in FIG. 2. FIG. 4 shows a lateral cross-sectional view taken along lines A–A' of FIG. 3. Reference is also made to FIG. 5, which diagrammatically depicts the geometric relationships attending the use and operation of the adjustable stroke connection apparatus of the present invention.

During normal operation, when there is no oil pressure at the interface 50 defined between crankshaft 14 (i.e., at the outer diameter surface of crankshaft eccentric 18) and eccentric bushing 20 (i.e., at its inner diameter surface), the bushing is fixedly secured to crankshaft 14 in a press-fit condition. By comparison, at the interface 52 between the outer diameter surface of bushing 20 and the connection surface of connection member 10, there is a small radial clearance that defines a separation between these components allowing relative rotation therebetween.

Referring to FIG. 5, the slide is actuated during this normal working operation of the press by the slider-crank torque-generating mechanism geometrically illustrated by the vector OAC. The effective press stroke length OA is a function of the bushing angle $\phi$.

During stroke length adjustment, high-pressure oil is injected into the press-fit mating surfaces at interface 50 between the inner diameter surface of bushing 20 and the outer diameter surface of crankshaft eccentric 18. Bushing 20 is expanded radially outwardly and causes the normal press-fit connection to become gradually released. Eventually, bushing 20 is brought into contacting, coupling engagement with the connection bore in such a manner that interface 52 becomes defined by a temporary press-fit connection. By comparison, interface 50 becomes defined by a small radial clearance between crankshaft eccentric 18 and bushing 20 that allows relative rotation therebetween pursuant to the stroke length adjustment procedure. In particular, referring to FIG. 5, the press stroke is adjusted by actuating the slide through the torque-generating slider-crank mechanism geometrically illustrated by the vector OBC. After adjustment, the oil pressure is reduced and the bushing again becomes clamped to the crankshaft in the normal press-fit connection. The press is now ready to work under a new stroke length.

As the bushing angle changes during a sequence of adjustment operations, the slide stroke will vary between a maximum stroke length and a minimum stroke length. One illustrative relationship between the stroke length and bushing angle is shown in the graph of FIG. 6.

As mentioned previously, a set of individual adjustment apparatus constructed in the manner shown in FIG. 2 may be provided at various axial locations along the crankshaft. When such multiple adjustment apparatus are used, it becomes important to ensure that the various adjustments carried out in each apparatus are identical. In particular, there must be the same rotary activity associated with rotating the crankshaft to a new location relative to the eccentric bushing during the temporary press fit connection condition. Otherwise, each adjustment apparatus will produce a different stroke length.

Figure 7:
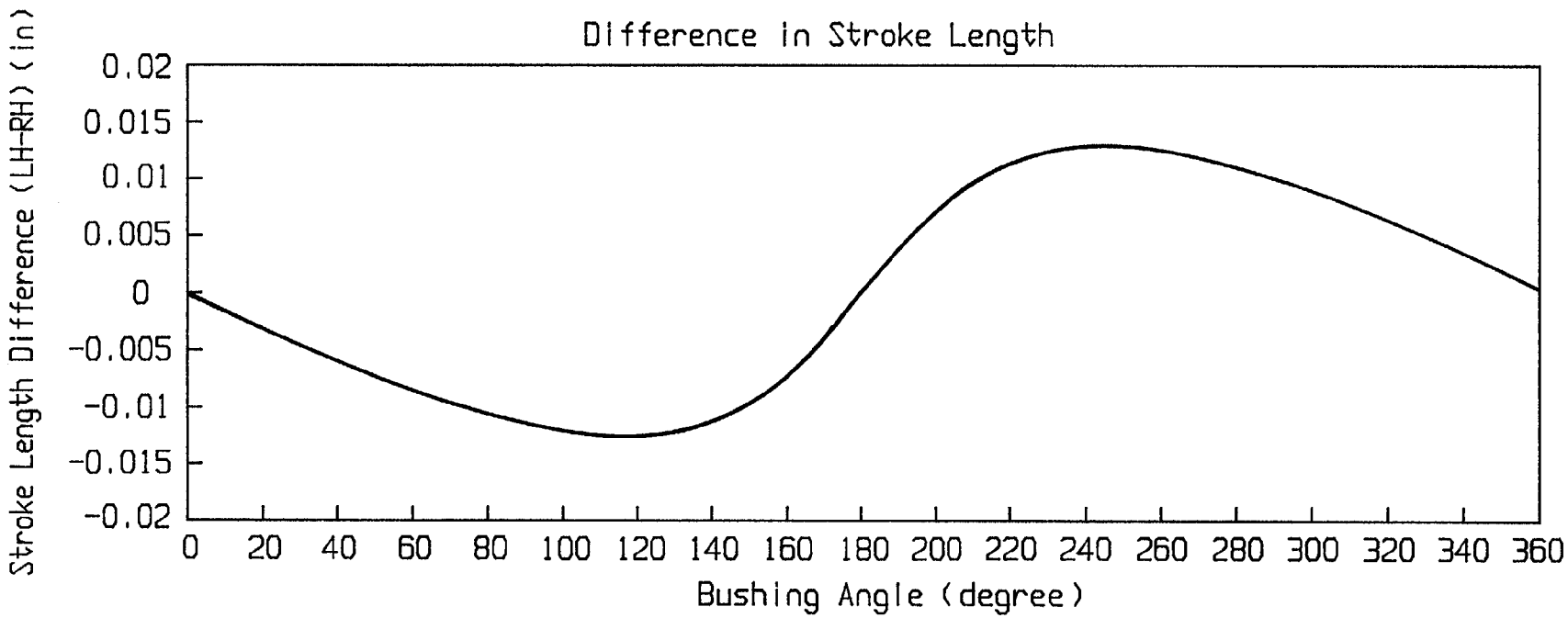
FIG. 7 is a graph plotting the difference in stroke length as a function of bushing angle.

An analysis was performed to monitor and investigate the behavior of the bushing angles associated with a pair of slide connection apparatus used to make stroke length adjustments. For purposes of explanation herein, the apparatus pair may be referred to as a left-hand connection and a right-hand connection. If manufacturing tolerance causes a phase angle difference between the left-hand connection bushing angle and the right-hand connection bushing angle, this condition will be manifested by a stroke length difference between the left-hand connection and the right-hand connection. This stroke length difference also depends upon the value of the bushing angle. In particular, FIG. 7 graphically shows the calculated stroke length difference variation at different bushing angles for 1.0 degree of phase difference between the left-hand to right-hand bushing angles.

Figure 6:
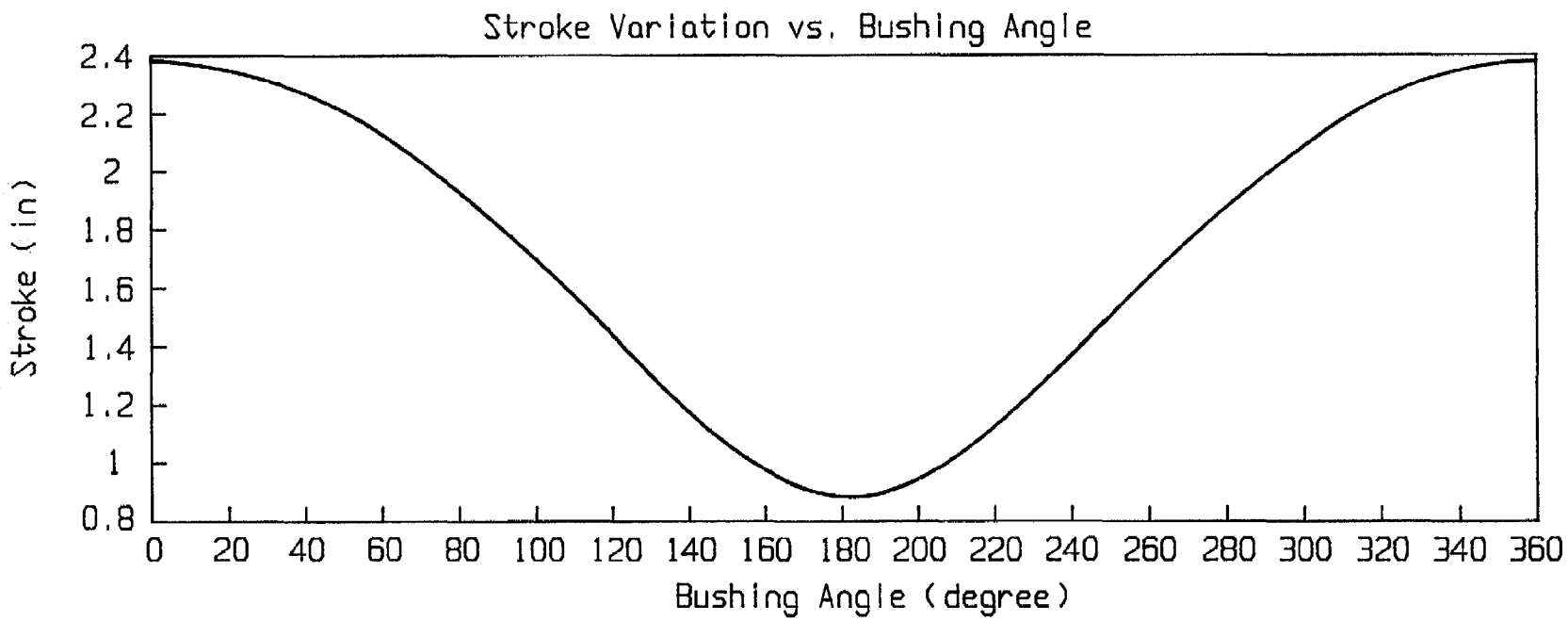
FIG. 6 is a graph depicting stroke variation versus bushing angle.
Figure 8:
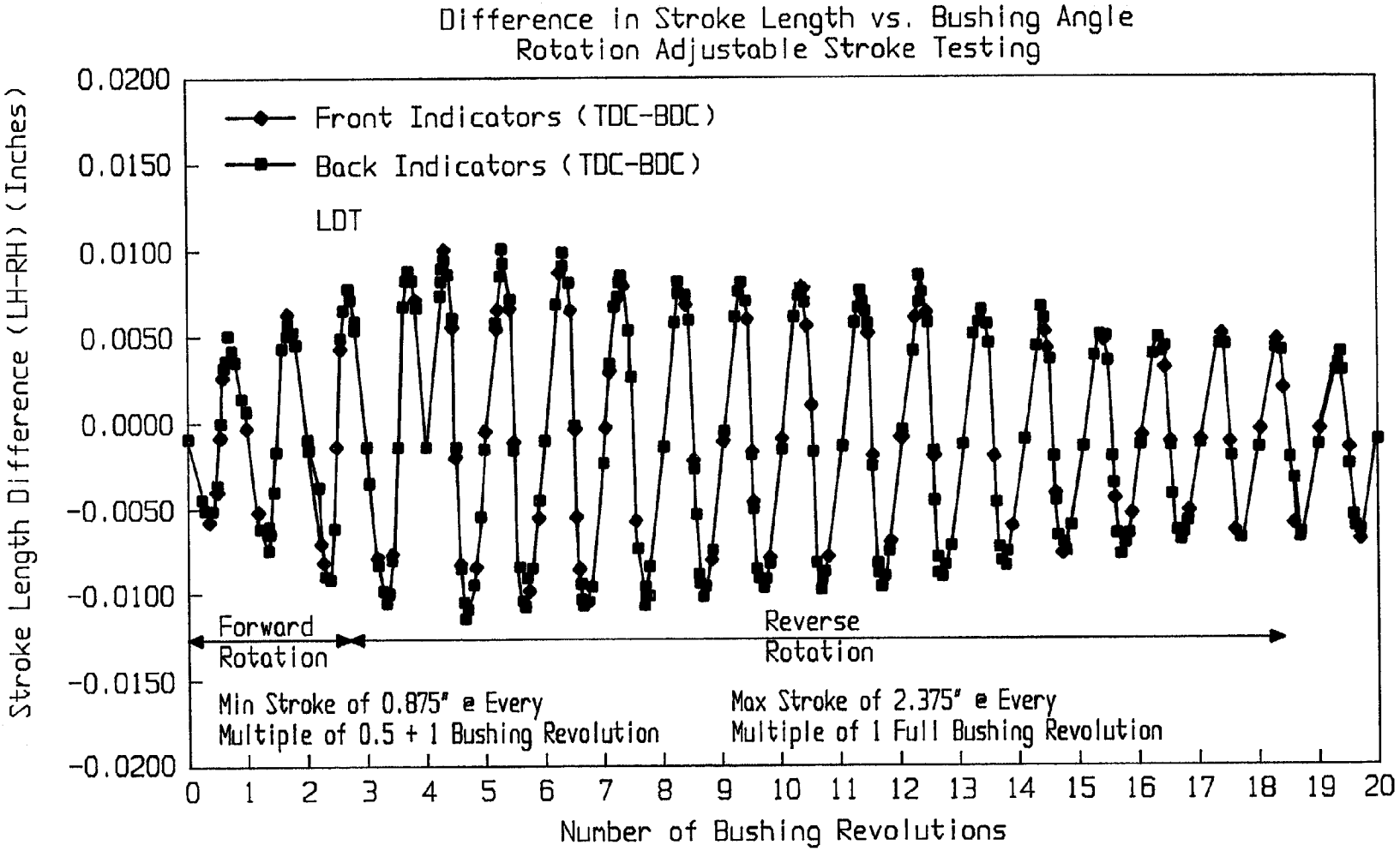
FIG. 8 is a graph illustrating the difference in stroke length versus bushing angle rotation during forward and reverse rotation.
Figure 6:
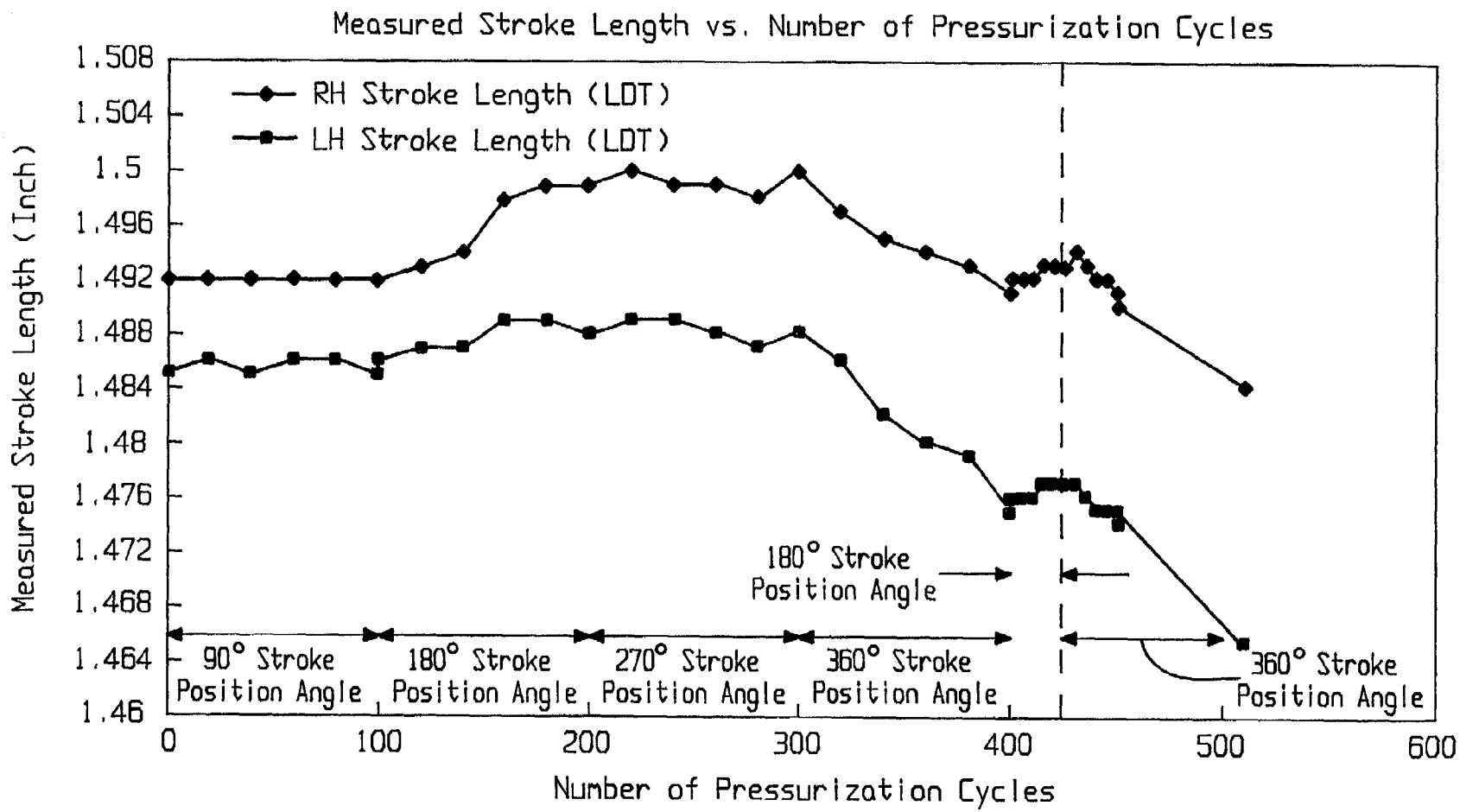

Tests conducted to determine stroke length adjustment characteristics as a function of bushing angle provided substantially the same stroke length to bushing angle relationship as shown in FIG. 6. The measured stroke length difference between the left-hand connection and right-hand connection basically follows the pattern depicted by FIG. 7. However, the testing data also shows a small variation of the peak stroke length difference as the bushing angle cycles, as shown in FIG. 8. These results indicated that there is a lapse in bushing angle slips between the left-hand and right-hand connections during stroke adjustment.

FIG. 8 also illustrates that the stroke length difference changes much faster in forward adjusting than in reverse adjusting. The average measured relative bushing angle slip is about 0.008 degrees per adjustment in forward adjusting and 0.0016 degrees per adjustment in reverse adjusting.

Additional tests revealed that the connection bushing also slips slightly under bushing expansion and contraction, as shown in FIG. 9. The bushing angle slip due to bushing expansion/contraction is not uniform. Test data showed that it ranges from a minimum of 0.0 degrees per bushing expansion/contraction to a maximum of 0.010 degrees per bushing expansion/contraction. Tests data also indicates that during bushing expansion/contraction, if the stroke length increases at one slide position crank angle, it will decrease at another slide position crank angle 180 degrees apart. However, it appears that the relative change in stroke length difference between the left-hand and right-hand connections goes only in one direction.

In sum, it has been recognized that some micro-level stroke length variations are occurring between individual slide connection adjustment apparatus during their respective actuations. As will be explained in more detail below, the source of such variations has been identified as a micro-slippage of the eccentric bushing that is occurring during the stroke adjustment operation. Although the relative change in stroke length difference per adjustment cycle is very small, it may become meaningful after hundreds of such adjustments. Accounting for such variations becomes an important part of properly operating the press machine.

What is presented below is a discussion of two physical mechanisms or phenomena that have been identified as being responsible for the relative bushing angle slip. One mechanism is associated with the non-uniform distribution of the driven torque during adjustment of the bushing angle/crankshaft (i.e., stroke length). The other mechanism relates to the presence of a torquing action which is induced by the slide weight and takes effect upon the eccentric bushing, and the concomitant shifting of the friction torque resistance between the press-fit mating surface and bushing seal to crank contact surface during bushing expansion and contraction. According to the present invention, compensation procedures and apparatus are provided to substantially reduce and/or eliminate the relative bushing angle slip attributable to the indicated mechanisms.

Relative Bushing Angle Slip During Stroke Length Adjustment

1. Occurring During Crankshaft Torquing

Figure 10:
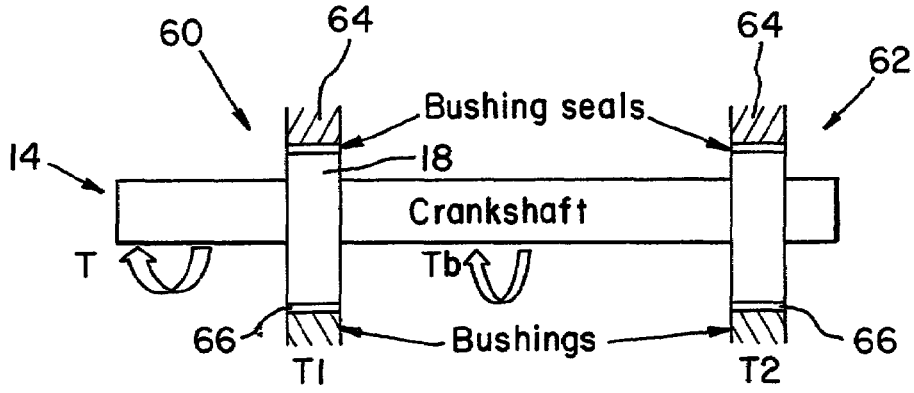
FIG. 10 is a schematic diagram of a slide adjustment assembly illustrating the non-uniform application of driving torque to a left-hand connection and a right-hand connection.

Referring to FIG. 10, there is shown an apparatus, in partial schematic lateral elevational view, which employs a first adjustment apparatus 60 (i.e., a left-hand connection) and a second adjustment apparatus 62 (i.e., a right-hand connection), both constructed in the manner of FIG. 2. Each apparatus 60 and 62 includes a respective bushing 64 and a bushing seal 66. As shown, the torque is applied at the end of crankshaft 14 proximate left-hand connection 60.

Under stroke adjusting conditions, the bushing 64 is clamped at its outer diameter surface to the connection bore. The crankshaft starts to rotate if the applied torque is larger than the total seal frictional drag torque. In particular, though bushing 64 is relieved of its press fit connection with the crankshaft eccentric and forms a temporary press fit connection with the connection member, the bushing seals remain in frictional contacting engagement with the crankshaft eccentric during expansion of the bushing. This frictional engagement acts as a resistance torque that inhibits or otherwise impedes the free rotation of the crankshaft during stroke adjustment.

As a torque T is applied at the end of the crankshaft 14 by a suitable drive mechanism, for example, it will cause a non-uniform torque distribution that varies along the longitudinal extent of the crankshaft. In particular, the instantaneous torque at any point along the crankshaft will, in a general way, vary inversely with the distance from the point of original torque application. The respective torque values at left-hand connection 60 and right-hand connection 62 are $T_1$ and $T_2$.

If $T_1$ reaches the seal static torque $T_{SEAL}$, the left seal starts to slip. This slippage means that the crankshaft 14 has overcome the resistance torque offered by the bushing seal and can now rotate in relation to the bushing seal. However, this slip is restrained if $T_2$ is still smaller than $T_{SEAL}$. After $T_2$ reaches $T_{SEAL}$, the left and right seals start to slip together. The maximum difference in seal slip angles can be calculated by:

$$\Delta\phi 1 = \frac{k_r}{k_r + 2} \cdot \frac{T_{sl} \cdot 12}{K_L}$$

The parameter $K_L$ is the torsional spring stiffness of the crankshaft between the two driving points (namely, left-hand connection 60 and right-hand connection 62), and $k_r$ is the ratio of $K_{SEAL}$ over $K_L$.

The parameter $K_{SEAL}$ is the bushing seal torsional spring stiffness or twisting stiffness. All the spring stiffness values are expressed in units of in-lb/degree. $T_{s1}$ is the applied torque that causes $T_1 = T_{SEAL}$. The parameter $T_{s1}$ is determined by:

$$T_{sl} = \frac{(k_r + 2) \cdot T_{SEAL} - (0.5dr + 1) \cdot T_b}{k_r + 1}$$

The parameter $T_b$ is the torque due to balancer weight. The unit for torque is ft-lb. The static seal torque at 7000 psi oil pressure is estimated as 2000 ft-lb per connection. A test measurement based on clutch oil pressure shows that the actual seal torque is around the 2000 ft-lb range.

After adjustment of the bushing angle, namely, by rotating the crankshaft relative to the eccentric bushing to change the effective stroke length, the slipping action of the bushing seals is stopped as the applied torque is removed and the crankshaft consequently stops rotating. Residual torque may be formed within the bushing seals. Any further bushing angle adjustments will not cause additional relative bushing angle slip. However, the residual torque will be released as the bushing is unclamped from the connection bore. Then, for each individual adjustment, the relative bushing angle slip between the left-hand connection 60 and the right-hand connection 62 is given by $\Delta\phi 1$. When the effect of variation in static seal torque and seal twisting stiffness is considered, it may cause some difference for relative bushing angle slip between forward adjusting and reverse adjusting.

According to one embodiment of the present invention, there is provided an apparatus for counteracting the aforementioned phenomena of relative bushing angle slip which is attributable to an asymmetric and/or non-uniform application of torque to the crankshaft. In particular, the relative bushing angle slip which occurs during bushing angle adjustment (namely, during rotation of the crankshaft to effectuate a new stroke length), may be eliminated by applying the driven torque in a symmetric manner or by using forward adjusting and reverse adjusting alternately to compensate the relative bushing angle slip.

Figure 11:
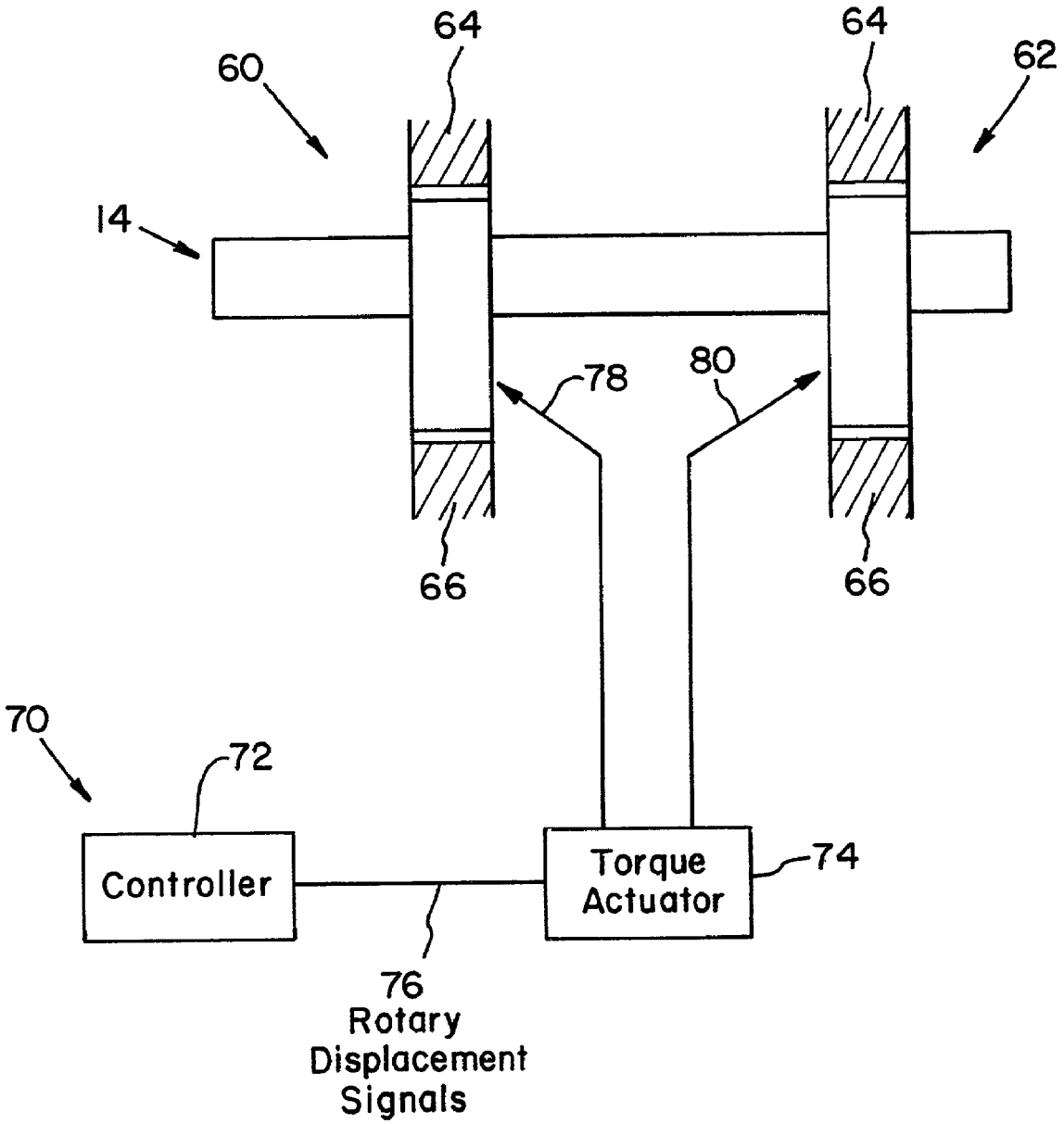
FIG. 11 is a schematic block diagram illustration of a torque driving control system according to one embodiment of the present invention.

More specifically, referring to FIG. 11, there is shown in block diagram schematic view a drive control system 70 for applying a torque to crankshaft 14 in a manner that uniformly drives each one of the slide connection apparatus. As shown, the illustrated system 70 includes a controller 72 and a torque actuator 74. The controller 72 determines or receives instructions on the rotational displacement of crankshaft 14 in furtherance of a bushing angle adjustment operation.

The torque actuator 74 is provided in torque-actuating relationship with each of left-hand connection 60 and right-hand connection 62 and may be implemented in any suitable manner enabling the delivery of rotational energy. For example, torque actuator 74 may be directly or indirectly coupled (via torque driving connections 78 and 80) to the respective crankshaft eccentric members of both connections 60 and 62. Alternately, torque actuator 74 may be coupled to the crankshaft main portion at locations immediately adjacent connections 60 and 62.

In response to rotary displacement signals 76 issued by controller 72, torque actuator 74 imparts the same torque to both left-hand connection 60 and right-hand connection 62, thereby producing the same rotary displacement in the crankshaft 14 at the axial location points associated with connections 60 and 62.

Preferably, a device will be provided that can accurately monitor the relative stroke length change and/or the lack of parallelism in the slide in order to detect a condition of relative bushing angle slip and instruct controller 72 to execute the compensation strategy.

Relative Bushing Angle Slip During Stroke Length Adjustment

2.Occurring During Bushing Expansion and Contraction

The stroke length adjustment procedure includes a bushing expansion operation and a bushing contraction operation. The bushing expansion operation precedes rotating adjustment of the crankshaft and includes pressurizing the interface between the crankshaft eccentric and bushing in order to relieve the normal press-fit connection therebetween and establish a temporary press-fit connection between the bushing and connection bore.

The bushing contraction operation follows rotating adjustment of the crankshaft and includes de-pressurizing the interface between the bushing and the connection bore in order to remove the temporary press-fit connection therebetween and restore the normal press-fit connection between the crankshaft eccentric and bushing.

During expansion and contraction of the bushing, a connection force due to the weight of the slide is exerted upon the slide adjustment apparatus and causes a static torque to be developed in the bushing with respect to the center of the crankshaft eccentric. As discussed below, this slide weight-induced torque is taken by the normal press-fit connection during the bushing contraction state, and is taken by bushing seal friction during the bushing expansion state. The crankshaft is stationary during expansion and contraction of the bushing; accordingly, the crankshaft does not communicate any torque to the bushing or anywhere else during this time.

Figure 12:
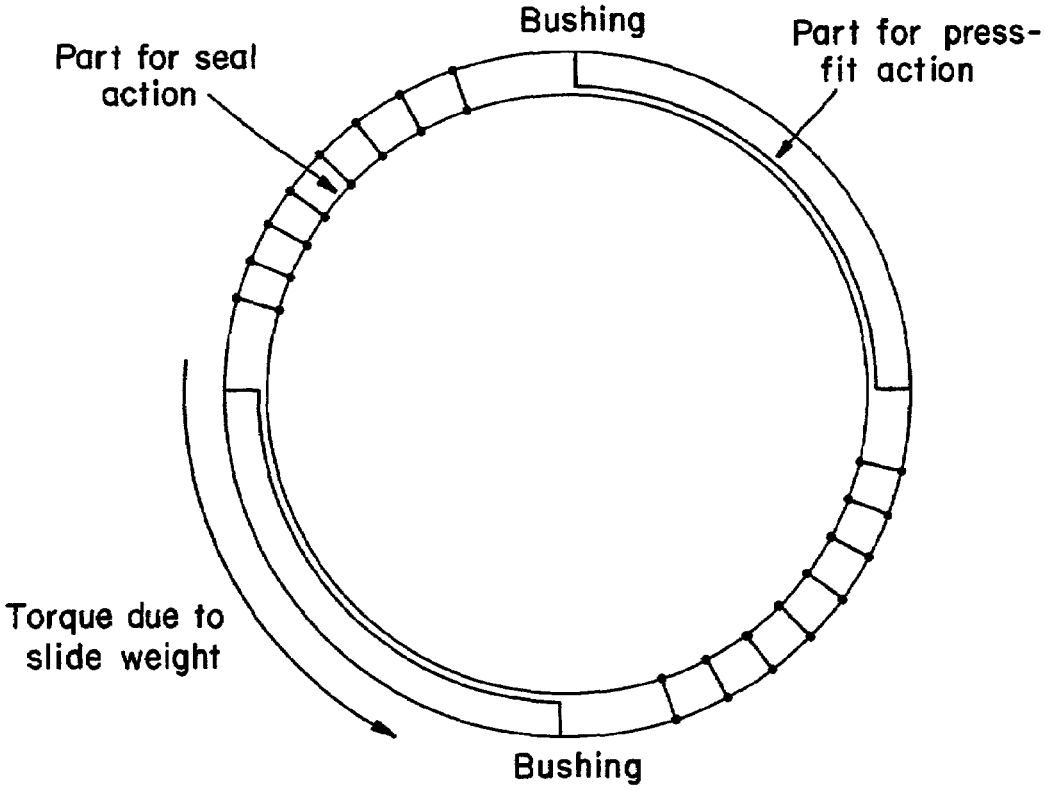
FIG. 12 is a schematic cross-sectional view of a crankshaft and bushing arrangement to illustrate the effect of bushing expansion and contraction upon relative bush angle slip.

Referring to FIG. 12, there is schematically shown an enlarged axial cross-sectional view of the crankshaft-bushing arrangement to illustrate the manner in which the slide weight-induced torque affects the components. In the contraction state, the bushing is held by the press-fit between the bushing inner diameter surface and the crankshaft eccentric outer diameter surface. The torque applied on the bushing with respect to the crank center (i.e., center of the crankshaft eccentric) due to the weight of the slide assembly is held by friction force on the press-fit mating surface.

Under expansion conditions, the press-fit is relieved and the slide-induced torque applied on the bushing is resisted by elastic deformation of the bushing seal. Because the seal is made of polymer material, its deflection under torque application can cause a relatively larger slip between the crank and bushing mating surface. When the bushing is contracting back to the press-fit state, the torque applied on the bushing is taken over (i.e., supplanted) by the friction force on the press-fit mating surface again and the relative twisting becomes a permanent slip.

Figure 13A:
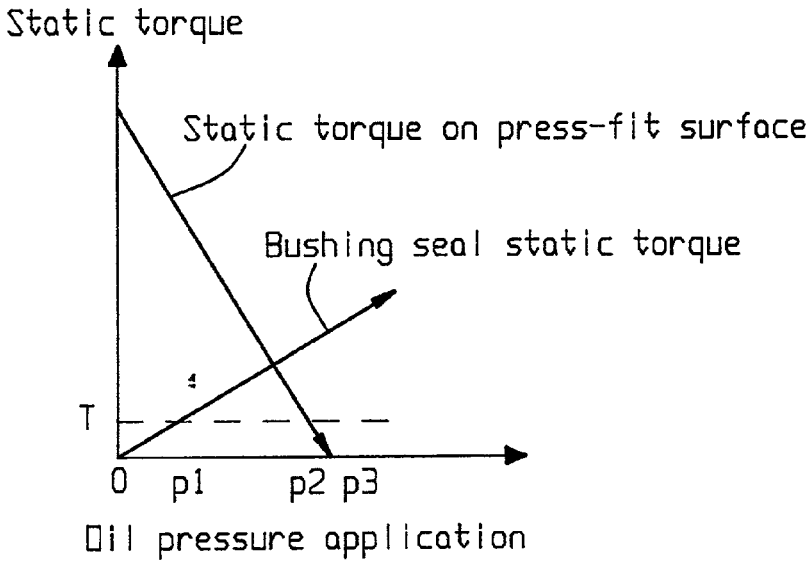
FIGS. 13A–B graphically depict torque distribution as a function of oil pressurization during bushing expansion.
Figure 13B:
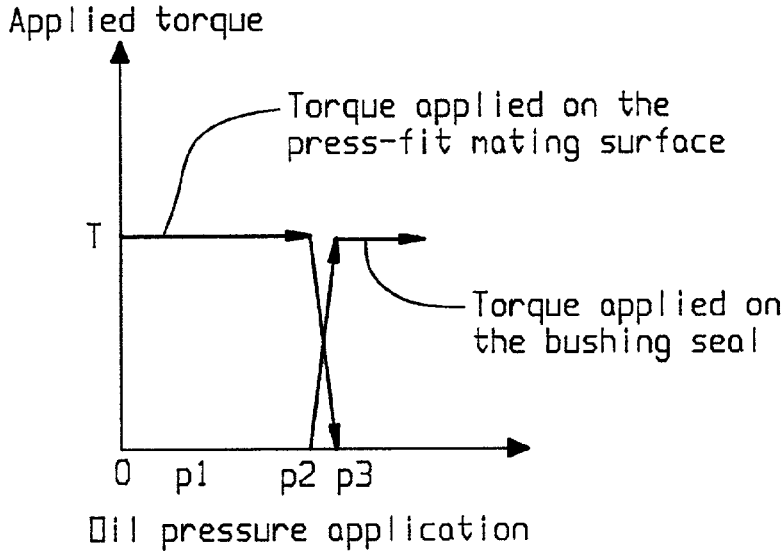

A more detailed description of the bushing slipping process is provided by the graphs in FIGS. 13A–D. Referring to FIGS. 13A–B, as oil pressure increases during the bushing expansion operation, the static torque due to the press-fit pressure decreases and the static torque due to bushing seal friction increases. At illustrative oil pressure $P_1$, the static seal torque is equal to the torque applied on the bushing, illustratively represented by torque value T. At oil pressure $P_2$, the static torque due to the press-fit pressure is equal to T. After pressure $P_2$, the torque applied on the bushing is gradually shifted from being held by friction on the press-fit mating surface to being held by seal friction. At oil pressure $p_3$, the static torque due to friction on the press-fit mating surface becomes zero. Then, the whole torque applied on the bushing is taken by the seal friction.

Figure 13C:
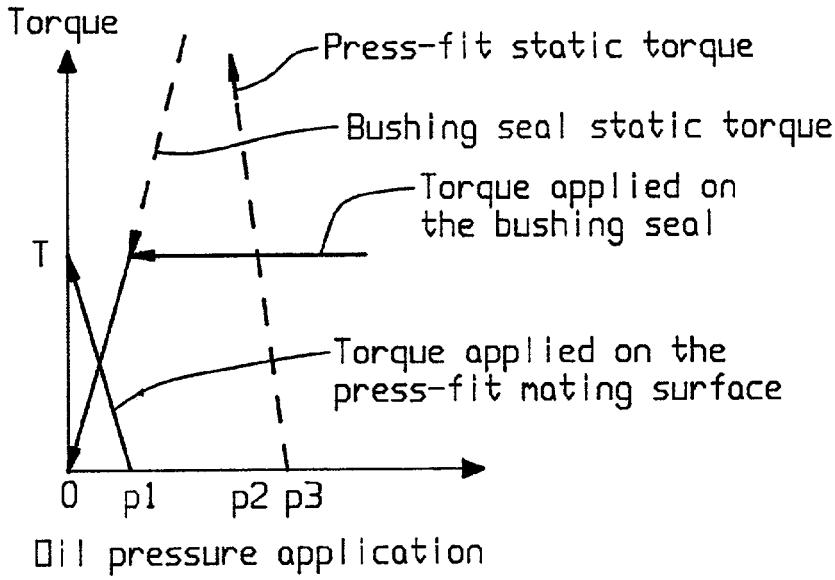
FIGS. 13C–D graphically depict torque distribution and bushing angle slip, respectively, as a function of hydraulic pressurization during bushing contraction/expansion.
Figure 13D:
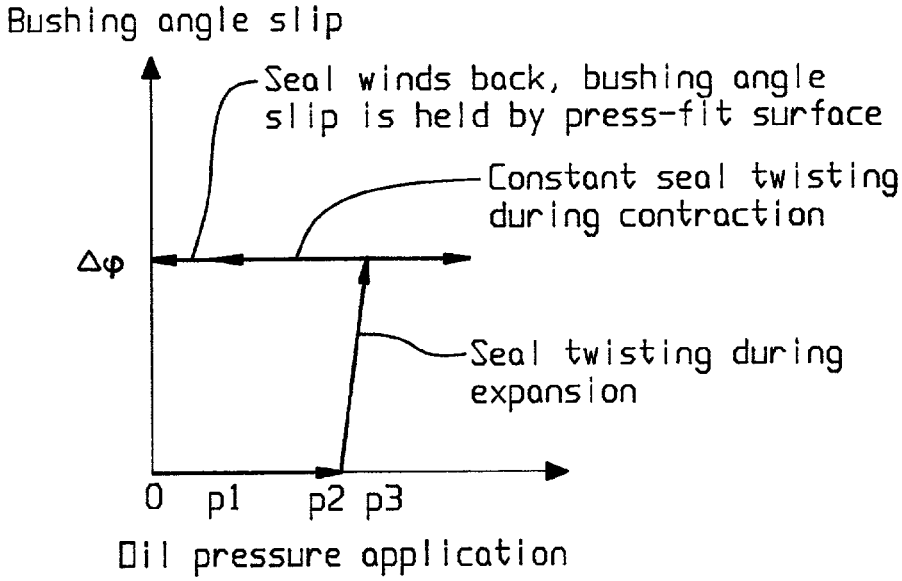

Referring to FIGS. 13C–D, as the oil pressure decreases to $p_3$ during the bushing contraction operation, the static torque due to friction on the press-fit mating surface starts to increase. At oil pressure $P_1$, the torque applied on the bushing is gradually shifted from being held by seal friction to being held by friction on the press-fit mating surface. (For these purposes, it is assumed that the static seal torque due to spring insert preload can be ignored.) Then, the seal static torque is reduced to zero at zero oil pressure. The seal is twisted by a small angle due to elastic deformation during bushing expansion. This small seal twisting is still kept intact during bushing contraction before the oil pressure is reduced towards $P_1$. As the oil pressure is further released, the seal starts to wind back to its undeformed state. However, the bushing slip will be kept because of the press-fit between the crankshaft eccentric and the bushing.

Figure 15:
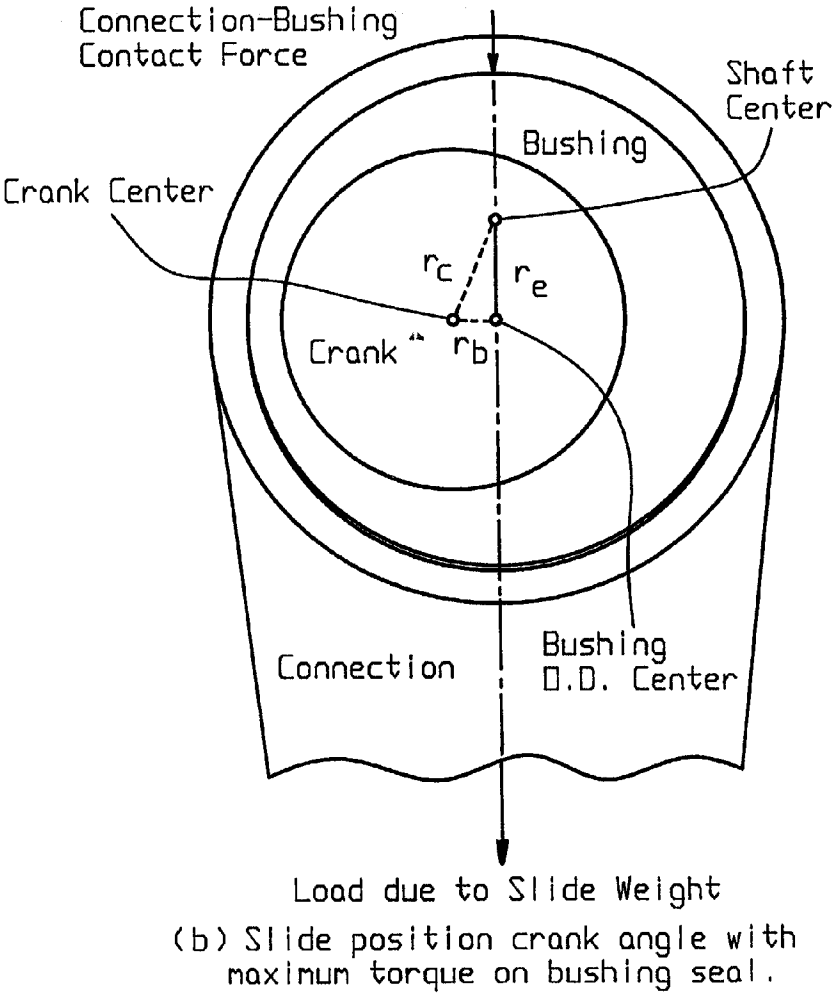
FIGS. 14 and 15 are schematic cross-sectional views of a slide adjustment apparatus illustrating a slide position crank angle orientation for producing minimum and maximum torque on the bushing seal, respectively.
Figure 14:
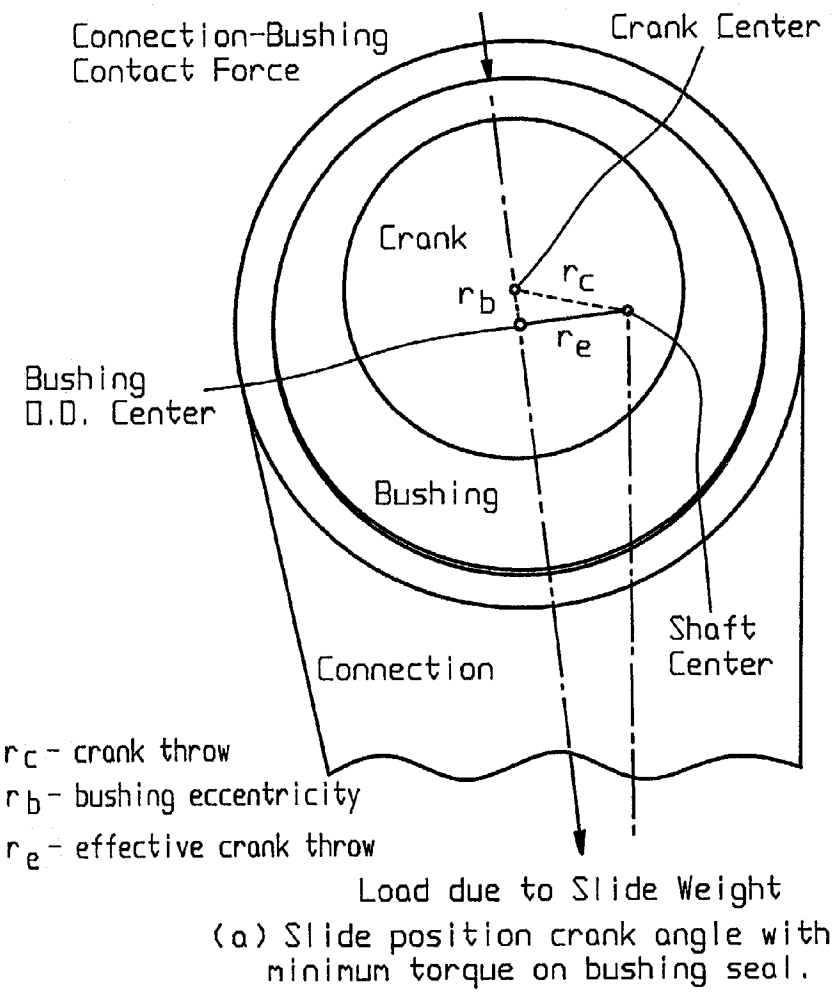

In sum, during the bushing expansion and contraction, the connection force due to the weight of the slide produces a static torque experienced by the eccentric bushing with respect to the crank center. The magnitude of this torque depends on the bushing angle and the slide position crank angle. A minimum bushing angle slip is associated with zero bushing torque, while maximum bushing angle slip is associated with maximum bushing torque. Referring to FIG. 14, there is shown an orientation for the crankshaft relative to the bushing (i.e., slide position crank angle) that results in minimum torque (i.e., zero) being applied to the bushing seal. Referring to FIG. 15, there is shown a slide position crank angle relationship that results in maximum torque being applied to the bushing seal.

According to another embodiment of the present invention, a control function is implemented during bushing contraction and expansion that appropriately selects the bushing angle and the slide position crank angle with a view towards minimizing relative bushing angle slip. For this purpose, the control function will make use of data such as shown in FIG. 16, which graphically depicts the corresponding bushing angles and slide position crank angles for maximum bushing angle slip or minimum bushing angle slip during bushing expansion and contraction.

Figure 16:
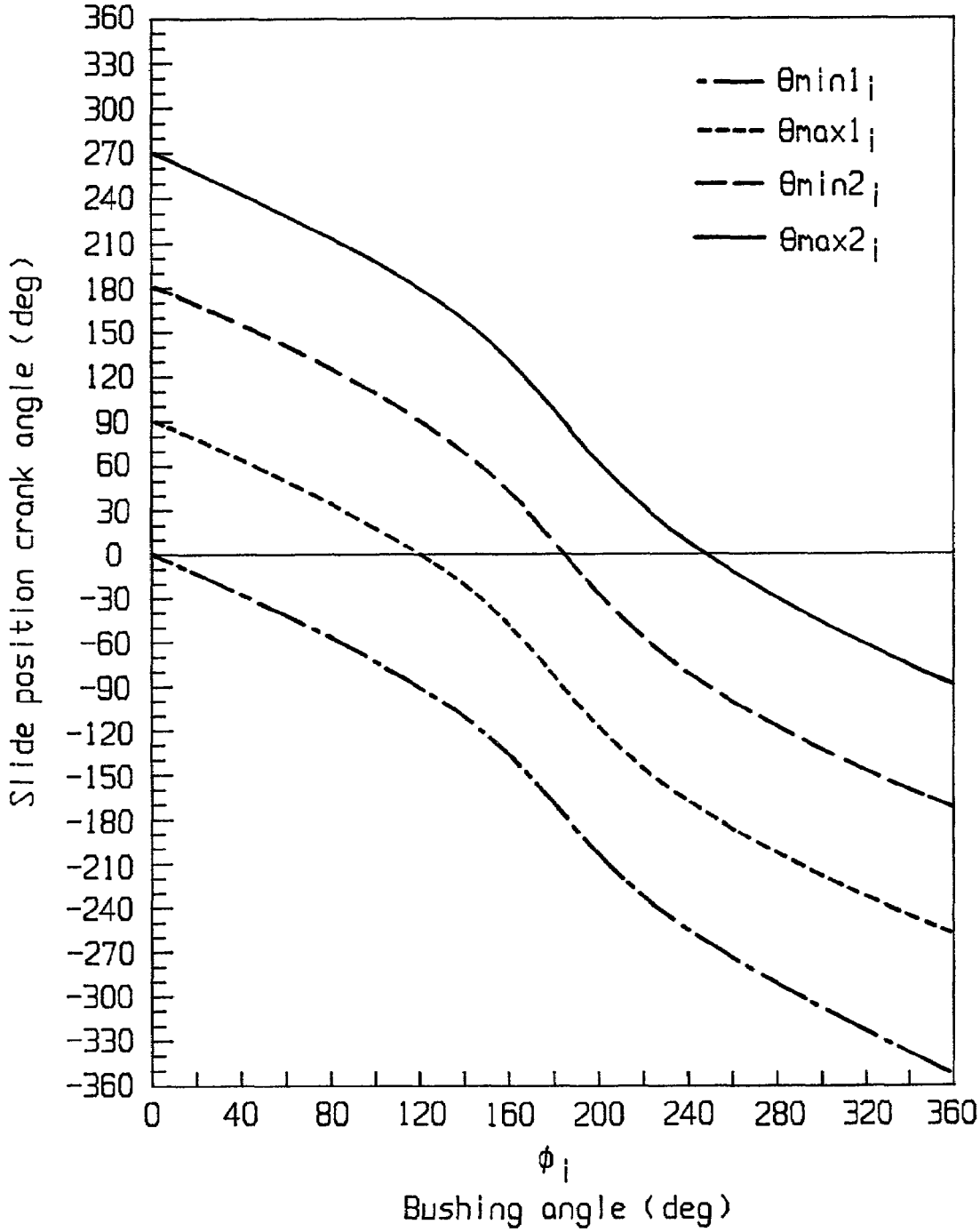
FIG. 16 is a graph illustrating bushing angles and slide position crank angles for maximum bushing angle slip and/or minimum bushing angle slip during bushing expansion and contraction, according to another embodiment of the present invention.

For example, if the bushing angle is 240°, the graph in FIG. 16 indicates that the slide position angles for minimum bushing angle slip are at about 90° and 270°, while the slide position angles for maximum bushing angle slip are at about 0° and 180°. The bushing angles slip for each bushing expansion/contraction can be calculated by:

$\Delta\phi_2 = T/K_{SEAL}$, where T is the torque applied on the bushing and $K_{SEAL}$ is the seal twisting stiffness. The direction of the bushing angle slip is in the same direction as the bushing torque application.

If all the material properties and manufacturing errors are perfectly symmetric, then the micro-slip of the bushing angle during bushing expansion/contraction should be the same for the left-hand connection and the right-hand connection. However, test results indicated that the bushing angle slip during bushing expansion/contraction is neither equal between the left-hand and right-hand connections, nor is symmetric to torque application direction. Because the static torque due to slide weight can be accurately determined during the bushing expansion and contraction, and it is much smaller than the static seal torque, the cause of the difference and directionality in bushing angle slip is likely due to changes in seal twisting stiffness.

Calculation of the Seal Twisting Stiffness and Bushing Angle Slip

The bushing seal preferably consists of a generally U-shaped seal jacket and an integral backup seal or ring. The backup seal is made from a stiffer polymer material compared to that for the seal jacket. Accordingly, during torquing action, the seal jacket and backup seal will behave differently.

Figure 17A:
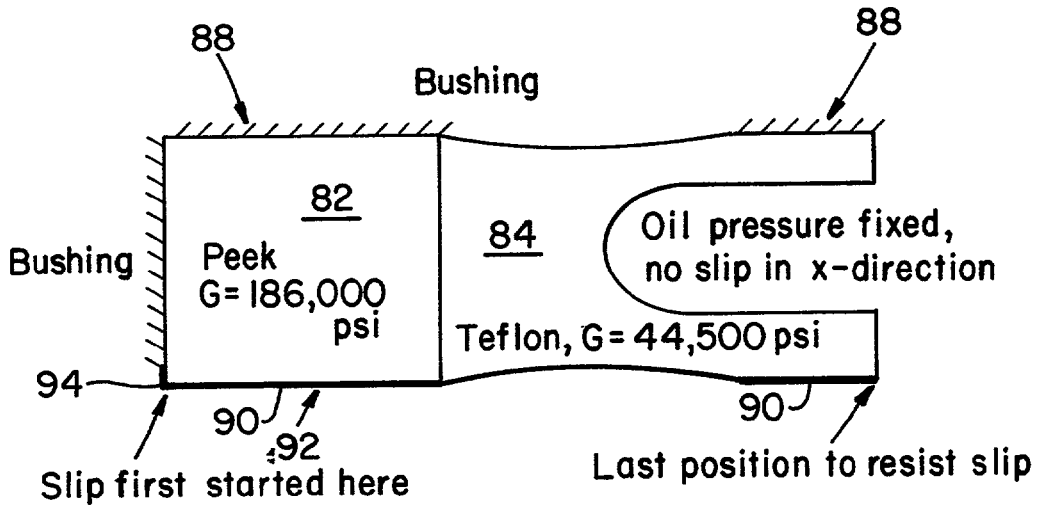
FIGS. 17A–B depict lateral and perspective schematic views, respectively, of a bushing seal to illustrate the bushing seal slip activity during bushing angle adjustment.
Figure 17B:
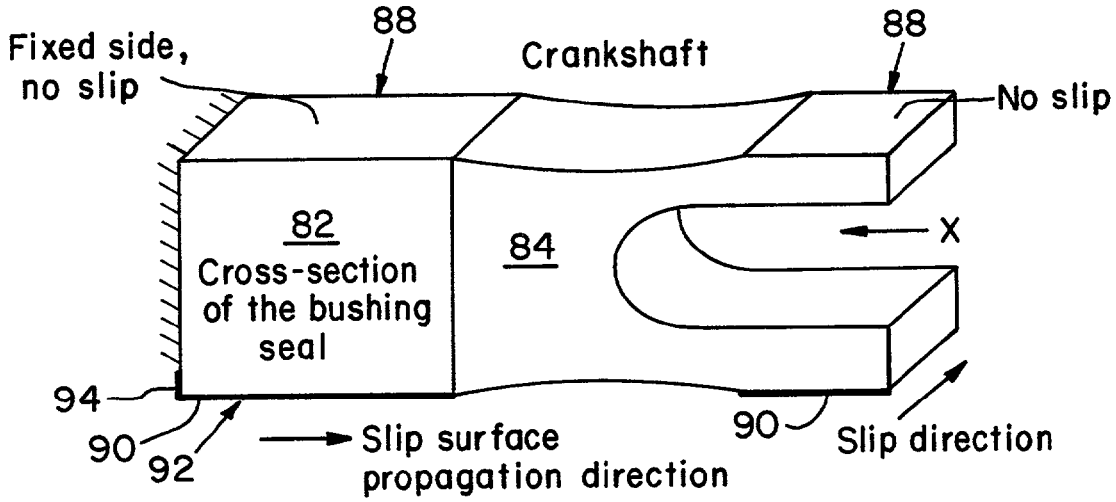

The seal slipping mechanism which acts during crankshaft adjustment is different from the seal slipping mechanism which occurs during bushing expansion/contraction. FIGS. 17A–B depict lateral and perspective views respectively of the bushing seal to illustrate the manner of bushing seal slippage during crankshaft adjustment (i.e., bushing angle adjustment). In the bushing angle adjustment condition, in order to make the whole seal slip, the torque applied on the seal has to first overcome the static seal torque. Because the static torque due to contact friction between the seal and bushing (i.e., at interface 88) is larger than the static torque due to contact friction between the seal and crankshaft (i.e., at interface 92), seal slip occurs on the surface 90 between the seal inner ring and the crankshaft eccentric outer diameter.

The initial slip is not uniform. As the driven torque increases, slip starts at the edge corner 94 of the backup seal inner ring 82 and gradually propagates in the manner shown to the seal jacket lip 84. Using a simplified model, the seal twisting stiffness during bushing angle adjustment was calculated as approximately 263,000 in-lb/deg. Because slip surfaces are quite consistent during bushing angle adjusting, variation in this seal twisting stiffness may not exceed 20% of the average seal twisting stiffness.

Figure 18A:
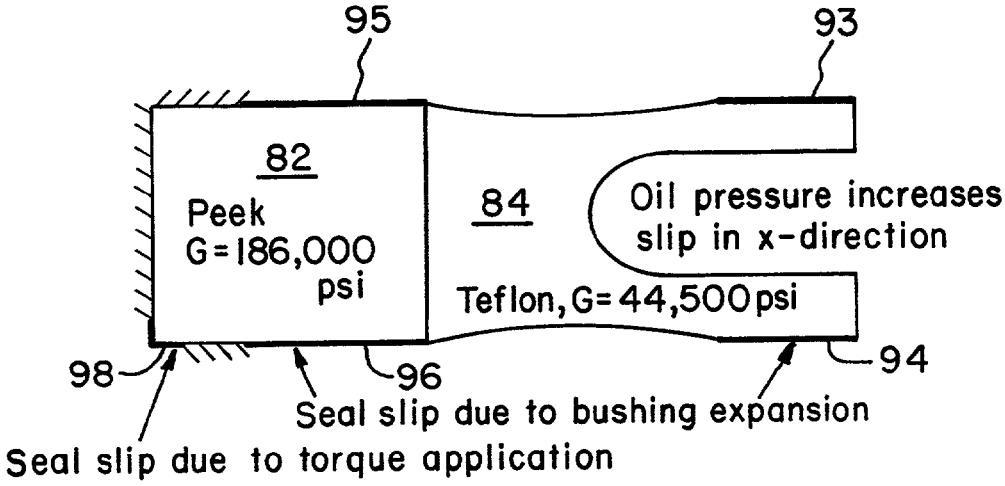
FIGS. 18A–B depict lateral and perspective schematic views, respectively, of a bushing seal to illustrate the bushing seal slip activity during bushing expansion.
Figure 18B:
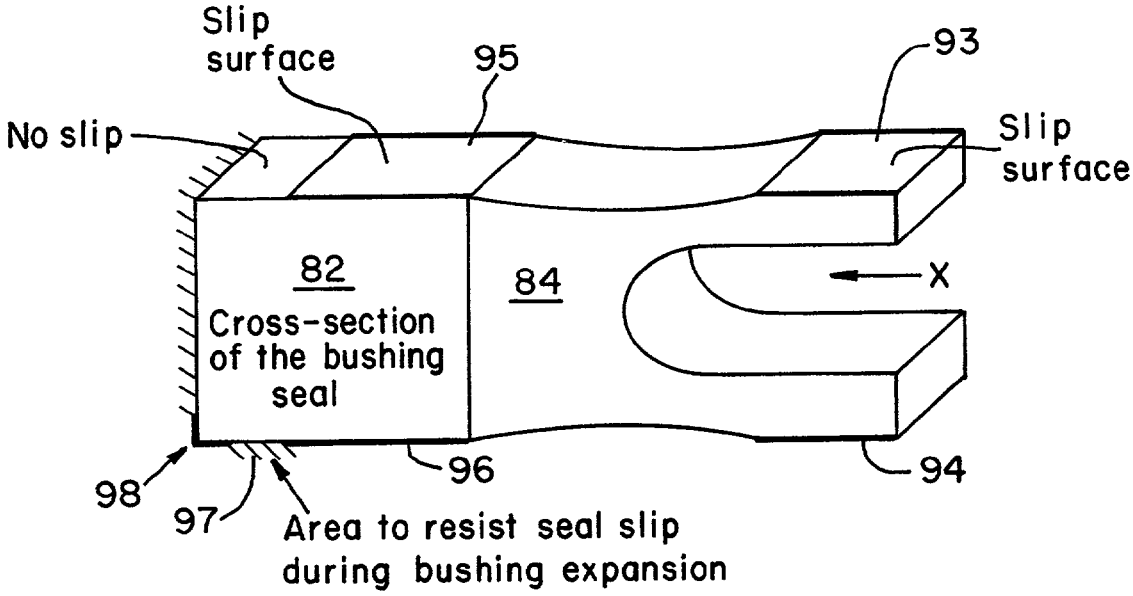

Turning now to an analysis of bushing seal slippage during bushing expansion/contraction, reference is made to FIGS. 18A–B which illustrate lateral and perspective views respectively of the bushing seal to indicate the manner of bushing seal slippage during bushing expansion/contraction. Measurement data from bushing expansion and contraction tests suggests that the seal twisting stiffness under the expansion/contraction condition is smaller than that under the bushing angle adjusting condition. For the experimental press machine, the maximum bushing torque due to slide weight is about 100 ft-lb per connection, which is far below the static seal torque. However, during the bushing expansion process, the seal undergoes deformation in response to the oil pressure.

Referring specifically to FIGS. 18A–B, the oil flow transmitted axially into seal jacket lip 84 in the indicated x-direction causes the seal jacket lip 84 (at upper and lower surfaces 93, 94) and part of the backup seal inner ring 82 (at upper and lower surfaces 95, 9 ) to slip along the shaft axial direction. Consequently, those surfaces 93, 94 and 95, 96 of seal jacket lip 84 and seal inner ring 82, respectively, will lose their resistance to bushing torque as the slippage occurs.

As oil pressure increases, the frictional force to resist bushing torque is gradually switched from the press-fit mating surface to the seal-to-crank contact surface. This area for torque resistance is actually a small portion of the backup seal-to-crank contact surface, and is indicated generally at 97. The bushing seal surface where seal slip occurs due to slide weight-induced torque application is indicated generally at 98, which represents the seal corner that defines the interface between the backup seal 82 and crankshaft eccentric. If the slide-induced torque is resisted uniformly by the entire backup seal inner ring surface, the calculated seal twisting stiffness is about 1,130,000 in-lb/deg. Because of the effect of the seal axial slip, the effective seal twisting stiffness during bushing expansion can be much smaller than that calculated above.

Another factor that may reduce the seal twisting stiffness is the effect of the connection force due to slide weight and upper die weight. This force has to be balanced by the bushing seal and it can cause the seal to be located off-center. If there is enough clearance for the backup seal, instead of the entire 360° circle, only part of the backup inner ring is in contact with the crank surface. To calculate the effective seal twisting stiffness, it is assumed that the effect of axial slip can reduce the seal twisting stiffness by a factor of ⅚, and the effect of the connection force can further reduce the seal twisting stiffness by a factor of ⅔. Then, the effective seal twisting stiffness is about 124,000 in-lb/deg.

The bushing expansion/contraction is not related to the direction of adjustment for the bushing angle. Bushing torque due to slide weight changes to opposite direction as the slide position crank angle turns 180°. Then, the bushing angle slip during bushing expansion/contraction may be canceled if the slide position crank angle can be paired as 180° apart. However, other factors may not be the same.

For example, factors such as the variation in seal gland depth, variation in seal thickness, run-out of the crank outer diameter and the magnitude of the torque applied on the seal can have significant bearing on the effect seal twisting stiffness during bushing expansion/contraction. It appears that if the effective seal gland depth is converging at one slide position crank angle, it will become diverging at another slide position crank angle 180° apart. Then, the relative change in bushing angle difference between the left-hand and right-hand connections is directional.

In view of the foregoing, it is realized that the overall relative change in bushing angle difference between the left-hand and right-hand connections includes such changes as caused by both bushing angle adjustments and bushing expansion/contraction. By combining the effects from both mechanisms of bushing slippage, it is possible to cause a much larger relative bushing angle slip between the left-hand and right-hand connections by adjusting the bushing angle in one direction than that by adjusting the bushing angle in the opposite direction.

Based upon the calculated seal twisting stiffness exhibited during bushing angle adjustment, the difference in bushing angle slip per adjusting cycle is computed to be about 0.0047°. From the above estimated seal twisting stiffness exhibited during bushing expansion/contraction, the maximum bushing angle slip per bushing expansion/contraction is about 0.0096°. Based upon the assumption that the average left-hand to right-hand difference in bushing angle slip is approximately one-fourth of the maximum bushing angle slip due to bushing expansion/contraction, then the calculated total left-hand to right-hand difference in bushing angle slip per adjustment is 0.0081° in forward adjusting and 0.0023° in reverse adjusting, which is consistent with the obtained test results.

Figure 19:
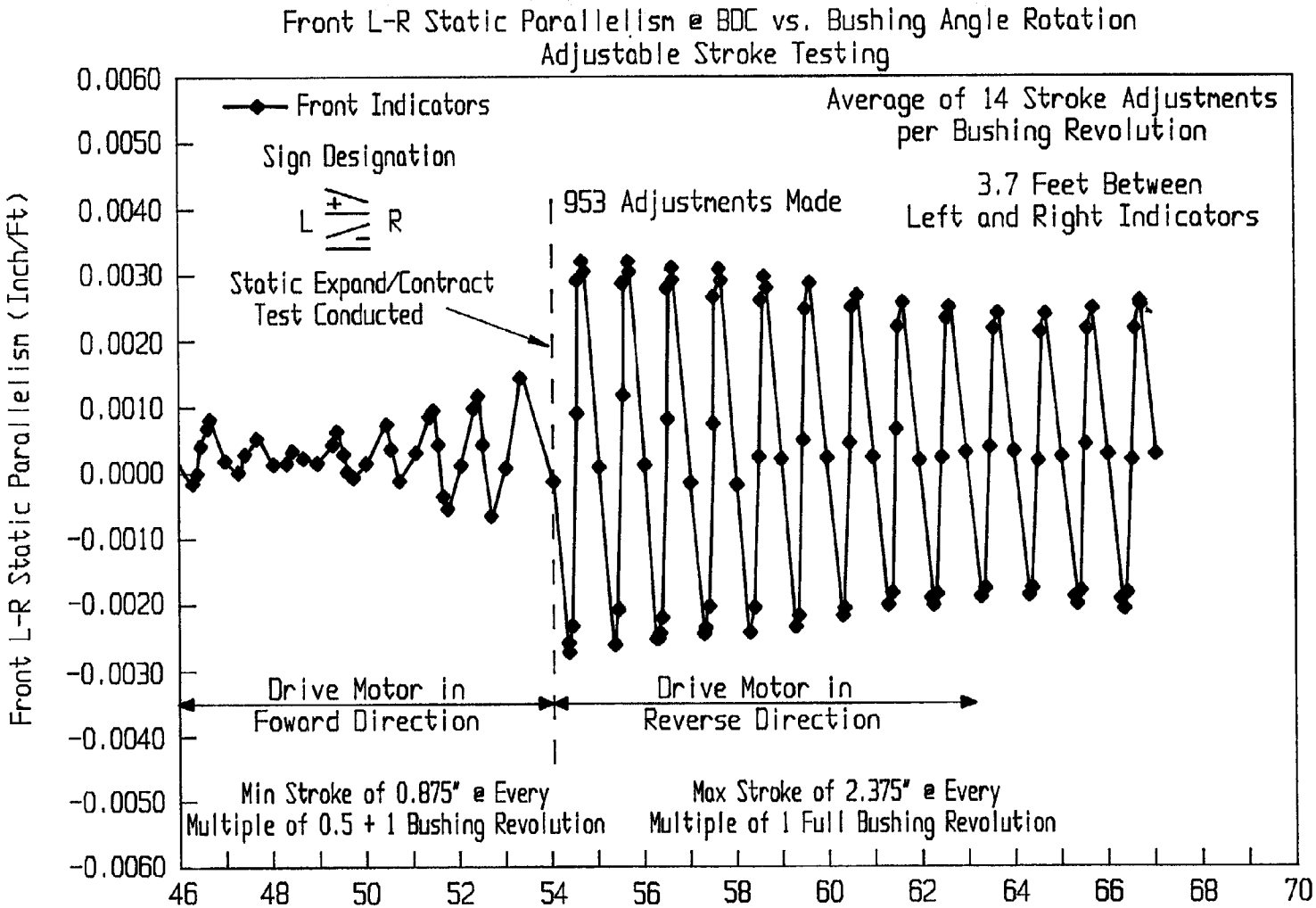
FIG. 19 graphically describes the static parallelism that is featured between the left-hand connection and right-hand connection as a function of bushing angle rotation for both a forward direction and reverse direction of adjustment.

FIG. 19 graphically describes the static parallelism that is featured between the left-hand connection and right-hand connection as a function of bushing angle rotation for both a forward direction and reverse direction of adjustment.

Another embodiment of the present invention is directed to a mechanical press using a slide parallelism measuring device. The press includes a rotatable crankshaft 14 and at least one eccentric crankshaft member 18 rotatably driven by the crankshaft 14. A respective eccentric bushing 20 is disposed about each eccentric member 18 and are releasably connectable with one another. A press connection member 10 is disposed in operative driving connection with each eccentric bushing 20. There is a means provided for reversibly removing each eccentric bushing 20 from its respective eccentric member 18. A torque actuator 74 is used to rotate the crankshaft and cause a press stroke adjustment. A controller 72 is used to activate the torque actuator 74 to apply torquing drive action to the eccentric crankshaft member 18 which rotates the crankshaft 14. A slide parallelism measuring device is used to measure the feedback signal from each side of the slide 119 and provides data to the control means 72 so that the control means 72 can rotate the crankshaft 14 into a position within the slides parallelism tolerance range.

Another embodiment of the present invention is an apparatus for correcting slide parallelism. The apparatus consists of at least one eccentric crankshaft member 14 connected to an eccentric controller for changing the position of the eccentric crankshaft member 14. A slide parallelism measuring device is used to gather data relating to the slide 119 and passes that data to the eccentric controller. The eccentric controller rotates the eccentric crankshaft member 14 based on the data from the slide parallelism measuring device.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mechanical press, comprising:

a rotatable crankshaft;

at least one eccentric crankshaft member rotatably driven by said rotatable crankshaft;

at least one eccentric bushing each disposed about a respective said eccentric member to define a respective interface therebetween, each said eccentric bushing and said associated eccentric member being releasably connectable with one another, each said eccentric bushing being normally operatively arranged in a press-fit connection with said associated eccentric member;

at least one press connection member each disposed in operative driving connection with a respective said eccentric bushing;

a bushing fit adjustment means for reversibly removing each said eccentric bushing from the press-fit connection with said associated eccentric member during a press stroke adjustment operation; and means for driving said crankshaft in rotation by applying a driving rotation to said crankshaft at a plurality of axial locations along said crankshaft, during the press stroke adjustment operation.

2. The mechanical press of claim 1, wherein said bushing fit adjustment means includes a high pressure oil supply configured for selectively supplying high pressure oil between each said eccentric member and said eccentric bushing associated therewith.

3. The mechanical press of claim 2, wherein said high pressure oil supply is configured for supplying oil between each said eccentric member and said eccentric bushing associated therewith in a manner sufficient to permit free movement relative to one another.

4. The mechanical press as recited in claim 1, wherein said driving means being configured to apply the driving rotation to said crankshaft via at least one of the at least one eccentric crankshaft member.

5. The mechanical press as recited in claim 1, wherein said driving means being configured to apply the driving rotation to said crankshaft by direct engagement with said crankshaft at a plurality of crankshaft locations each adjacent a respective said eccentric crankshaft member.

6. A mechanical press, comprising:

a rotatable crankshaft;

at least one eccentric crankshaft member rotatably driven by said rotatable crankshaft;

at least one eccentric bushing each disposed about a respective said eccentric member to define a respective interface therebetween, each said eccentric bushing and said associated eccentric member being releasably connectable with one another, each said eccentric bushing being normally operatively arranged in a press-fit connection with said associated eccentric member;

at least one press connection member each disposed in operative driving connection with a respective said eccentric bushing;

a bushing fit control means, being operative in a bushing expansion mode during a press stroke adjustment operation to reversibly remove each said eccentric bushing from the normal press-fit connection with said associated eccentric member by expanding said eccentric bushing at least in part towards its associated press connection member, and being further operative in a bushing contraction mode to restore each said eccentric bushing subjected to expansion to the normal press-fit connection with said associated eccentric member;

an angle control means, operative during at least one of the respective bushing expansion mode and the respective bushing contraction mode associated with at least one of said eccentric bushings, for controlling at least one of the slide position crank angle of said crankshaft and the respective bushing angle for at least one of said eccentric bushings, the control function performed by said angle control means being directed towards minimization of relative bushing angle slip between respective pairs of said eccentric bushings and said eccentric members; and means for driving said crankshaft in rotation by applying a driving rotation to said crankshaft at a plurality of axial locations along said crankshaft, during the press stroke adjustment operation.

7. The mechanical press of claim 6, wherein said bushing fit control means includes a high pressure oil supply configured for selectively supplying high pressure oil between each said eccentric member and said eccentric bushing associated therewith.

8. The mechanical press of claim 7, wherein said high pressure oil supply is configured for supplying oil between each said eccentric member and said eccentric bushing associated therewith in a manner sufficient to permit free movement relative to one another.

9. The mechanical press of claim 6, wherein said angle control means is configured for calculating the bushing angle slip associated with at least one pair of adjacent eccentric bushings and compensates therefor by initiating an appropriate press stroke adjustment.

10. The mechanical press as recited in claim 6, wherein said driving means being configured to apply the driving rotation to said crankshaft via at least one of the at least one eccentric crankshaft member.

11. The mechanical press as recited in claim 6, wherein said driving means being configured to apply the driving rotation to said crankshaft by direct engagement with said crankshaft at a plurality of crankshaft locations each adjacent a respective said eccentric crankshaft member.

12. A mechanical press having a slide, said press comprising:

a rotatable crankshaft;

at least one eccentric crankshaft member rotatably driven by said rotatable crankshaft;

at least one eccentric bushing each disposed about a respective said eccentric member to define a respective interface therebetween, each said eccentric bushing and said associated eccentric member being releasably connectable with one another, each said eccentric bushing being normally operatively arranged in a press-fit connection with said associated eccentric member;

at least one press connection member each disposed in operative driving connection with a respective said eccentric bushing and said slide;

a bushing fit adjustment means for reversibly removing each said eccentric bushing from the press-fit connection with said associated eccentric member during a press stroke adjustment operation;

means for driving said crankshaft in rotation by applying a driving rotation to said crankshaft at a plurality of axial locations along said crankshaft, during the press stroke adjustment operation;

a controller to activate said driving means; and a device for measuring slide parallelism and transferring measurement data to said controller.

13. The mechanical press of claim 12, wherein the slide parallelism being a measure of the difference in bushing slip angle associated with each of a left-hand side and a right-hand side of one said eccentric bushing.

14. The mechanical press as recited in claim 12, wherein said driving means being configured to apply the driving rotation to said crankshaft via at least one of the at least one eccentric crankshaft member.

15. The mechanical press as recited in claim 12, wherein said driving means being configured to apply the driving rotation to said crankshaft by direct engagement with said crankshaft at a plurality of crankshaft locations each adjacent a respective said eccentric crankshaft member.

16. A method for use with a press machine, said press machine including a rotatable crankshaft, at least one eccentric member rotatably driven by said crankshaft, and at least one eccentric bushing each disposed about a respective said eccentric member, each eccentric bushing being releasably connected to the eccentric member associated therewith in a selectively releasable press-fit connection, said method comprising the steps of:

selectively releasing each eccentric bushing from the respective press-fit connection with the eccentric member associated therewith; and rotating said crankshaft by applying a driving rotation to said crankshaft at a plurality of axial locations along said crankshaft, the rotating operation occurring at least one of during and following the selective releasing step.

17. The method as recited in claim 16, wherein the rotating step further includes the step of:

communicating the driving rotation to said crankshaft via at least one of the at least one eccentric member.

18. The method as recited in claim 16, wherein the rotating step further includes the step of:

applying the driving rotation directly to at least one of the at least one eccentric member.

19. The method as recited in claim 16, wherein the rotating step further includes the step of:

directly engaging said crankshaft at a plurality of crankshaft locations each adjacent a respective said eccentric member.

20. The method as recited in claim 16, wherein the rotating step further includes the step of:

applying the driving rotation directly to said crankshaft.

* * * * *